US009879865B2

(12) United States Patent
McKee et al.

(10) Patent No.: US 9,879,865 B2
(45) **Date of Patent: *Jan. 30, 2018**

(54) COOKING OVEN

(71) Applicant: ALTO-SHAAM, INC., Menomonee Falls, WI (US)

(72) Inventors: Philip R. McKee, Frisco, TX (US); Lee Thomas VanLanen, McKinney, TX (US); Todd Coleman, Farmers Branch, TX (US)

(73) Assignee: Alto-Shaam, Inc., Menomonee Falls, WI (US)

( * ) Notice: Subject to any disclaimer, the term of this patent is extended or adjusted under 35 U.S.C. 154(b) by 213 days.

This patent is subject to a terminal disclaimer.

(21) Appl. No.: 15/016,093

(22) Filed: Feb. 4, 2016

(65) Prior Publication Data

US 2016/0356504 A1 Dec. 8, 2016

Related U.S. Application Data

(63) Continuation-in-part of application No. 14/733,533, filed on Jun. 8, 2015, now Pat. No. 9,677,774.

(51) Int. Cl.

| | |
|---|---|
| ***F24C 15/32*** | (2006.01) |
| *F24C 15/00* | (2006.01) |
| *F24C 15/16* | (2006.01) |

(52) U.S. Cl.

CPC ..... *F24C 15/322* (2013.01); *F24C 15/00* (2013.01); *F24C 15/007* (2013.01); *F24C 15/16* (2013.01)

(58) Field of Classification Search

CPC ..... F24C 15/32; F24C 15/00; F24C 15/007; F24C 15/16

(Continued)

(56) References Cited

U.S. PATENT DOCUMENTS 1,527,020 A 2/1925 Valliant
2,098,295 A 11/1937 Kettering et al.

(Continued)

FOREIGN PATENT DOCUMENTS

CN 202066327 U 12/2011
EP 0002784 A1 7/1979

(Continued)

OTHER PUBLICATIONS

Charlotte Atchley, Uniting Technologies, dated Feb. 1, 2015. See http://www.bakingbusiness.com/Features/Operations/2015/2/Uniting%20Technologies.aspx?cck=1.

(Continued)

*Primary Examiner* — Gregory Huson
*Assistant Examiner* — Nikhil Mashruwala
(74) *Attorney, Agent, or Firm* — Boyle Fredrickson S.C.

(57) ABSTRACT

A cooking oven is disclosed. The cooking oven comprises a housing having an oven cavity and an oven door for access to the oven cavity, at least one air blower for generating heated air, one or more air channels for directing the heated air from the air blower toward the oven cavity, and one or more removable air plenums, wherein each removable air plenum is connected to one of the one or more air channels, comprises an air intake edge for receiving the heated air from the air channel, defines the top or the bottom of a cooking chamber within the oven cavity, and comprises a plurality of air vents for directing the heated air into the cooking chamber. The cooking oven may further comprise a control panel for separately and independently controlling each of the cooking chambers defined by the removable air plenums.

24 Claims, 13 Drawing Sheets

(58) Field of Classification Search
USPC ..... 126/21 A, 21 R, 19 A; 219/400, 403
See application file for complete search history.

(56) References Cited

U.S. PATENT DOCUMENTS 2,214,630 A 9/1940 Wheeler
2,305,056 A 12/1942 Austin
2,491,687 A 12/1949 Nutt
2,513,846 A 7/1950 Collins
2,683,795 A 7/1954 Sheidler
2,715,898 A 8/1955 Michaelis et al.
2,940,381 A 6/1960 Cottongim et al.
3,221,729 A * 12/1965 Harding, Jr. ..... A23L 3/365 126/21 A
3,232,072 A 2/1966 Barroero
3,304,406 A 2/1967 King
3,326,201 A 6/1967 Murray
3,335,499 A 8/1967 Larsson
3,514,576 A 5/1970 Hilton et al.
3,538,904 A 11/1970 Baker
3,568,590 A 3/1971 Grice
3,658,047 A 4/1972 Happel
3,674,982 A 7/1972 Hoyt
3,789,516 A 2/1974 Schraft et al.
3,828,760 A 8/1974 Farber et al.
3,884,213 A 5/1975 Smith
3,908,533 A 9/1975 Fagerstrom et al.
3,935,809 A 2/1976 Bauer
3,946,651 A 3/1976 Garcia
4,038,968 A 8/1977 Rovell
4,110,916 A 9/1978 Bemrose
4,154,861 A 5/1979 Smith
4,162,141 A 7/1979 West
4,189,995 A 2/1980 Lohr et al.
4,307,286 A 12/1981 Guibert
4,307,659 A 12/1981 Martin et al.
4,313,485 A 2/1982 Gidge et al.
4,323,110 A 4/1982 Rubbright
4,326,342 A 4/1982 Schregenberger
4,338,911 A 7/1982 Smith
4,354,549 A 10/1982 Smith
4,366,177 A 12/1982 Wells et al.
4,374,319 A 2/1983 Guibert
4,377,109 A 3/1983 Brown et al.
4,381,442 A 4/1983 Guibert
4,389,562 A 6/1983 Chaudoir
4,395,233 A 7/1983 Smith
4,397,299 A 8/1983 Taylor et al.
4,404,898 A 9/1983 Chaudoir
4,455,478 A 6/1984 Guibert
4,462,383 A 7/1984 Henke et al.
4,471,750 A 9/1984 Burtea
4,472,887 A 9/1984 Avedian et al.
4,474,498 A 10/1984 Smith
4,479,775 A 10/1984 Smith
4,484,561 A 11/1984 Baggott et al.
4,492,839 A 1/1985 Smith
4,515,143 A 5/1985 Jabas
4,516,012 A 5/1985 Smith et al.
4,601,237 A 7/1986 Harter et al.
4,605,038 A 8/1986 Tchitdjian
4,625,867 A 12/1986 Guibert
4,626,661 A 12/1986 Henke
4,631,029 A 12/1986 Lanham et al.
4,690,127 A 9/1987 Sank
4,700,619 A 10/1987 Scanlon
4,714,050 A 12/1987 Nichols
4,722,683 A 2/1988 Royer
4,727,853 A 3/1988 Stephan et al.
4,739,154 A 4/1988 Bharara et al.
4,750,276 A 6/1988 Smith et al.
4,757,800 A 7/1988 Shei et al.
4,822,981 A 4/1989 Chaudoir
4,829,158 A 5/1989 Burnham
4,829,982 A 5/1989 Abidor
4,835,351 A 5/1989 Smith et al.
4,865,864 A 9/1989 Rijswijck
4,867,132 A 9/1989 Yencha
4,870,254 A 9/1989 Arabori
4,876,426 A 10/1989 Smith
4,892,030 A 1/1990 Grieve
4,895,137 A 1/1990 Jones et al.
4,928,663 A 5/1990 Nevin et al.
4,951,645 A 8/1990 Luebke et al.
4,960,977 A 10/1990 Alden
4,965,435 A 10/1990 Smith et al.
4,981,416 A 1/1991 Nevin et al.
4,994,181 A 2/1991 Mullaney, Jr.
5,025,775 A 6/1991 Crisp
5,050,578 A 9/1991 Luebke et al.
5,121,737 A 6/1992 Yencha, III
5,172,682 A 12/1992 Luebke et al.
5,180,898 A 1/1993 Arden et al.
5,211,106 A 5/1993 Lucke
5,222,474 A 6/1993 Yencha, III
5,223,290 A 6/1993 Alden
5,228,385 A 7/1993 Friedrich et al.
5,231,920 A 8/1993 Alden et al.
5,254,823 A 10/1993 McKee et al.
5,272,317 A 12/1993 Ryu
5,309,981 A 5/1994 Binder
5,345,923 A 9/1994 Luebke et al.
5,361,749 A 11/1994 Smith et al.
5,365,039 A 11/1994 Chaudoir
5,404,935 A 4/1995 Liebermann
5,421,316 A 6/1995 Heber
5,421,317 A 6/1995 Cole et al.
5,434,390 A 7/1995 McKee et al.
5,454,295 A 10/1995 Cox et al.
5,458,051 A 10/1995 Alden et al.
5,460,157 A 10/1995 Prabhu
5,483,044 A 1/1996 Thorneywork et al.
5,492,055 A 2/1996 Nevin et al.
5,497,760 A 3/1996 Alden et al.
5,507,382 A 4/1996 Hartwell et al.
5,520,095 A 5/1996 Huber et al.
5,530,223 A 6/1996 Culzoni et al.
5,558,793 A 9/1996 McKee et al.
5,572,984 A 11/1996 Alden et al.
5,577,438 A 11/1996 Amitrano et al.
5,582,093 A 12/1996 Amitrano et al.
5,620,731 A 4/1997 McKee
5,647,740 A 7/1997 Kobaru
5,655,511 A 8/1997 Prabhu et al.
5,676,044 A 10/1997 Lara, Jr.
5,683,240 A 11/1997 Smith et al.
5,720,273 A 2/1998 Trullas
5,747,775 A 5/1998 Tsukamoto et al.
5,847,365 A 12/1998 Harter
5,880,436 A 3/1999 Keogh
5,908,574 A 6/1999 Keogh
5,927,265 A 7/1999 McKee et al.
5,928,072 A 7/1999 Fulcher et al.
5,928,541 A 7/1999 Tsukamoto et al.
5,934,178 A 8/1999 Caridis et al.
5,934,182 A 8/1999 Harter et al.
5,941,235 A 8/1999 Carter
5,951,901 A 9/1999 Douglas et al.
5,954,986 A 9/1999 Tsukamoto et al.
5,988,154 A 11/1999 Douglas et al.
5,990,466 A 11/1999 McKee et al.
5,994,673 A 11/1999 El-Shoubary
6,008,483 A 12/1999 McKee et al.
6,031,208 A 2/2000 Witt et al.
6,049,066 A 4/2000 Wilson
6,058,924 A 5/2000 Pool, III et al.
6,060,701 A 5/2000 McKee et al.
6,064,050 A 5/2000 Ishikawa et al.
6,079,321 A 6/2000 Harter et al.
6,111,224 A 8/2000 Witt
6,116,895 A 9/2000 Onuschak
6,140,619 A 10/2000 Couch
6,140,626 A 10/2000 McKee et al.
6,146,678 A 11/2000 Caridis et al.

(56) References Cited

U.S. PATENT DOCUMENTS 6,175,099 B1 1/2001 Shei et al.
6,192,877 B1 2/2001 Moshonas et al.
6,218,650 B1 4/2001 Tsukamoto et al.
6,252,201 B1 6/2001 Nevarez
6,259,064 B1 7/2001 Wilson
6,262,394 B1 7/2001 Shei et al.
6,262,396 B1 7/2001 Witt et al.
6,262,406 B1 7/2001 McKee et al.
6,320,165 B1 11/2001 Ovadia
6,323,462 B1 11/2001 Strand
6,350,965 B2 2/2002 Fukushima et al.
6,359,271 B1 3/2002 Gidner et al.
6,376,817 B1 4/2002 McFadden et al.
6,378,602 B2 4/2002 Brown
6,384,381 B2 5/2002 Witt et al.
6,399,930 B2 6/2002 Day et al.
6,403,937 B1 6/2002 Day et al.
6,425,388 B1 7/2002 Korinchock
6,441,355 B2 8/2002 Thorneywork
6,455,085 B1 9/2002 Duta
6,476,368 B2 11/2002 Aronsson et al.
6,486,455 B1 11/2002 Merabet
6,494,130 B2 12/2002 Brown
6,517,882 B2 2/2003 Elia et al.
6,526,961 B1 3/2003 Hardenburger
6,528,773 B2 3/2003 Kim et al.
6,534,688 B2 3/2003 Klausmeyer
6,539,934 B2 4/2003 Moshonas et al.
6,541,739 B2 4/2003 Shei et al.
6,552,305 B2 4/2003 De'Longhi
6,576,874 B2 6/2003 Zapata et al.
6,592,364 B2 7/2003 Zapata
6,595,117 B1 7/2003 Jones et al.
6,614,007 B1 9/2003 Reay
6,655,373 B1 12/2003 Wiker
6,660,982 B2 12/2003 Thorneywork
6,692,788 B1 2/2004 Mottram et al.
6,693,261 B2 2/2004 Leutner
6,712,063 B1 3/2004 Thorneywork
6,712,064 B2 3/2004 Stacy et al.
6,716,467 B2 4/2004 Cole et al.
6,805,112 B2 10/2004 Cole et al.
6,817,201 B2 11/2004 Yingst
6,817,283 B2 11/2004 Jones et al.
6,818,869 B2 11/2004 Patti
6,833,032 B1 12/2004 Douglas et al.
6,833,533 B1 12/2004 Wolfe et al.
6,860,279 B2 * 3/2005 Dunn ..... B08B 3/102
134/182
6,869,538 B2 3/2005 Yu et al.
6,874,495 B2 4/2005 McFadden
6,880,545 B2 4/2005 Heber et al.
6,903,318 B2 6/2005 Thorneywork
6,914,221 B1 7/2005 Witt et al.
6,933,472 B1 8/2005 Smith et al.
6,933,473 B2 8/2005 Henke et al.
6,934,690 B1 8/2005 Van Horn et al.
6,943,321 B2 9/2005 Carbone et al.
6,968,565 B1 11/2005 Slaney et al.
7,019,272 B2 3/2006 Braunisch et al.
7,055,518 B2 6/2006 McFadden et al.
7,082,941 B2 8/2006 Jones et al.
7,087,872 B1 8/2006 Dobie et al.
7,105,779 B2 9/2006 Shei
7,192,272 B2 3/2007 Jones et al.
7,196,291 B2 3/2007 Cothran
7,220,946 B2 5/2007 Majchrzak
7,227,102 B2 6/2007 Shei
7,326,882 B2 2/2008 Faries, Jr. et al.
7,328,654 B2 2/2008 Shei
7,328,695 B2 2/2008 Tatsumu et al.
7,329,847 B2 2/2008 Tatsumu et al.
7,343,912 B2 3/2008 Jones et al.
7,360,533 B2 4/2008 McFadden
RE40,290 E 5/2008 Shei et al.
7,370,647 B2 5/2008 Thorneywork
7,424,848 B2 9/2008 Jones et al.
7,435,931 B1 10/2008 McKee et al.
7,446,282 B2 11/2008 Shei et al.
7,468,495 B2 12/2008 Carbone
7,480,627 B1 1/2009 Van Horn et al.
7,493,362 B2 2/2009 Bogatin et al.
7,507,938 B2 3/2009 McFadden
7,554,057 B2 6/2009 Monny Dimouamoua
7,575,000 B2 8/2009 Jones et al.
7,604,002 B2 10/2009 Rabas et al.
7,624,676 B2 12/2009 Nishida et al.
7,624,728 B1 12/2009 Forbes
7,781,702 B2 8/2010 Nam et al.
7,784,457 B2 8/2010 Akdag et al.
7,792,920 B2 9/2010 Istvan et al.
7,793,586 B2 9/2010 Rabas
7,825,358 B2 11/2010 Kim
7,836,874 B2 11/2010 McFadden
7,836,875 B2 11/2010 McFadden et al.
7,884,306 B2 2/2011 Leach
7,886,658 B2 2/2011 McFadden et al.
7,900,228 B2 3/2011 Stark et al.
7,905,173 B2 3/2011 Sus et al.
7,910,866 B2 3/2011 Hwang et al.
7,921,841 B2 4/2011 McKee et al.
7,941,819 B2 5/2011 Stark et al.
7,942,278 B2 5/2011 Martin et al.
7,946,224 B2 5/2011 McFadden
7,956,304 B2 6/2011 Bacigalupe et al.
8,006,685 B2 8/2011 Bolton et al.
8,011,293 B2 9/2011 McFadden et al.
8,029,274 B2 10/2011 Jones et al.
8,035,062 B2 10/2011 McFadden et al.
8,035,065 B2 10/2011 Kim et al.
8,042,533 B2 * 10/2011 Dobie ..... A21B 1/245
126/19 R
8,047,128 B2 11/2011 Salvaro
8,058,590 B2 11/2011 Thorneywork et al.
8,058,594 B2 11/2011 Hwang
8,063,342 B2 11/2011 Hines, Jr.
8,071,922 B2 12/2011 Claesson et al.
8,093,538 B2 1/2012 Claesson et al.
8,113,190 B2 2/2012 Dougherty
8,124,200 B2 2/2012 Quella et al.
8,134,101 B2 3/2012 Majchrzak
8,134,102 B2 3/2012 McKee et al.
8,136,442 B2 3/2012 Strutin-Belinoff et al.
8,143,560 B2 3/2012 Park et al.
8,164,036 B2 4/2012 Lee
8,168,928 B2 5/2012 Kim et al.
8,210,844 B2 7/2012 Wolfe et al.
8,212,188 B2 7/2012 Kim
8,218,955 B2 7/2012 Witt
8,224,892 B2 7/2012 Bogatin et al.
8,253,084 B2 8/2012 Toyoda et al.
8,258,440 B2 9/2012 Shei et al.
8,292,494 B2 10/2012 Rosa et al.
8,297,270 B2 10/2012 McFadden
8,304,702 B2 11/2012 Kim
8,338,756 B2 12/2012 Shei et al.
8,359,351 B2 1/2013 Istvan et al.
8,378,265 B2 2/2013 Greenwood et al.
8,389,907 B2 3/2013 Willett
8,399,812 B2 3/2013 Thorneywork et al.
8,490,475 B2 7/2013 Dejmek
8,561,321 B2 10/2013 Inoue et al.
8,586,900 B2 11/2013 Kim et al.
8,637,792 B2 1/2014 Agnello
8,658,953 B2 2/2014 McFadden et al.
8,680,439 B2 3/2014 Shei et al.
8,680,449 B2 3/2014 Kim
8,695,487 B2 4/2014 Sakane et al.
8,707,945 B2 4/2014 Hasslberger
8,733,236 B2 5/2014 McKee
8,735,778 B2 5/2014 Greenwood et al.
8,746,134 B2 6/2014 McKee
8,893,705 B2 11/2014 McFadden
8,895,902 B2 11/2014 Shei et al.

(56) References Cited

U.S. PATENT DOCUMENTS

| | | | |
|---|---|---|---|
| 8,941,041 | B2 | 1/2015 | Lee |
| 8,968,848 | B2 | 3/2015 | Quella et al. |
| 8,991,383 | B2 | 3/2015 | Johnson |
| 8,993,945 | B2 | 3/2015 | McKee et al. |
| 9,074,776 | B2 | 7/2015 | Greenwood et al. |
| 9,074,777 | B2 | 7/2015 | Catalogne et al. |
| 9,134,033 | B2 | 9/2015 | Nevarez et al. |
| 9,157,639 | B2 | 10/2015 | Gallici et al. |
| 9,161,547 | B2 | 10/2015 | McKee |
| RE45,789 | E | 11/2015 | Shei et al. |
| 9,265,400 | B2 | 2/2016 | Bigott |
| 9,277,598 | B2 | 3/2016 | Lee et al. |
| 9,288,997 | B2 | 3/2016 | McKee |
| 9,301,646 | B2 | 4/2016 | Rosa et al. |
| 9,303,879 | B2 | 4/2016 | Price et al. |
| 9,326,639 | B2 | 5/2016 | McKee et al. |
| 9,341,382 | B2 | 5/2016 | Kim |
| 9,351,495 | B2 | 5/2016 | McFadden |
| 9,372,006 | B2 | 6/2016 | McKee et al. |
| 9,474,284 | B2 | 10/2016 | Dougherty |
| 9,480,364 | B2 | 11/2016 | McKee et al. |
| 9,516,704 | B2 | 12/2016 | Stanger |
| 9,791,201 | B1 * | 10/2017 | Howard ..... F25D 25/04 |
| 2001/0025842 | A1 | 10/2001 | Witt et al. |
| 2002/0003140 | A1 | 1/2002 | Day et al. |
| 2002/0134778 | A1 | 9/2002 | Day et al. |
| 2003/0141296 | A1 | 7/2003 | Thorneywork |
| 2004/0026401 | A1 | 2/2004 | Jones et al. |
| 2004/0163635 | A1 | 8/2004 | Thorneywork |
| 2005/0000957 | A1 | 1/2005 | Jones et al. |
| 2005/0045173 | A1 | 3/2005 | Heber et al. |
| 2005/0173397 | A1 | 8/2005 | Majchrzak et al. |
| 2005/0205547 | A1 | 9/2005 | Wenzel |
| 2005/0211109 | A1 | 9/2005 | Majchrzak et al. |
| 2005/0258171 | A1 | 11/2005 | Witt |
| 2006/0020962 | A1 | 1/2006 | Stark et al. |
| 2006/0026636 | A1 | 2/2006 | Stark et al. |
| 2006/0026638 | A1 | 2/2006 | Stark et al. |
| 2006/0031880 | A1 | 2/2006 | Stark et al. |
| 2006/0041927 | A1 | 2/2006 | Stark et al. |
| 2006/0064720 | A1 | 3/2006 | Istvan et al. |
| 2006/0080408 | A1 | 4/2006 | Istvan et al. |
| 2006/0085825 | A1 | 4/2006 | Istvan et al. |
| 2006/0085835 | A1 | 4/2006 | Istvan et al. |
| 2006/0102017 | A1 | 5/2006 | Rabas et al. |
| 2006/0201495 | A1 | 9/2006 | Jones et al. |
| 2007/0092670 | A1 | 4/2007 | Quella et al. |
| 2007/0108179 | A1 | 5/2007 | Hines, Jr. |
| 2007/0125319 | A1 | 6/2007 | Jones et al. |
| 2007/0210064 | A1 | 9/2007 | Quella et al. |
| 2008/0008795 | A1 | 1/2008 | Thorneywork et al. |
| 2008/0092754 | A1 | 4/2008 | Noman |
| 2008/0105133 | A1 | 5/2008 | McFadden et al. |
| 2008/0105136 | A1 | 5/2008 | McFadden |
| 2008/0105249 | A1 | 5/2008 | McFadden et al. |
| 2008/0106483 | A1 | 5/2008 | McFadden et al. |
| 2008/0127833 | A1 | 6/2008 | Lee |
| 2008/0134903 | A1 | 6/2008 | Kim et al. |
| 2008/0148961 | A1 | 6/2008 | Hwang et al. |
| 2008/0148963 | A1 | 6/2008 | Kim et al. |
| 2008/0149628 | A1 | 6/2008 | Thorneywork et al. |
| 2008/0149630 | A1 | 6/2008 | Hwang |
| 2008/0149631 | A1 | 6/2008 | Lee |
| 2008/0149632 | A1 | 6/2008 | Kim et al. |
| 2008/0149633 | A1 | 6/2008 | Kim |
| 2008/0156202 | A1 | 7/2008 | Park et al. |
| 2008/0245359 | A1 | 10/2008 | Williamson |
| 2008/0296284 | A1 | 12/2008 | McFadden et al. |
| 2008/0302253 | A1 | 12/2008 | Salvaro |
| 2009/0095727 | A1 | 4/2009 | Majchrzak |
| 2009/0139367 | A1 | 6/2009 | Rosa et al. |
| 2009/0142719 | A1 | 6/2009 | Scheuring, III et al. |
| 2009/0165778 | A1 | 7/2009 | Harter et al. |
| 2009/0222612 | A1 | 9/2009 | Thorneywork et al. |
| 2010/0000509 | A1 | 1/2010 | Babington |
| 2010/0031193 | A1 | 2/2010 | Stark et al. |
| 2010/0054717 | A1 | 3/2010 | Lee et al. |
| 2010/0058936 | A1 | 3/2010 | Schjerven, Sr. et al. |
| 2010/0126979 | A1 | 5/2010 | Willett |
| 2010/0133263 | A1 | 6/2010 | Toyoda et al. |
| 2010/0166398 | A1 | 7/2010 | Witt |
| 2010/0320198 | A1 | 12/2010 | Kim |
| 2010/0320199 | A1 | 12/2010 | Kim |
| 2010/0326290 | A1 | 12/2010 | Gallici et al. |
| 2010/0332994 | A1 | 12/2010 | Istvan et al. |
| 2011/0005409 | A1 | 1/2011 | Majchrzak |
| 2011/0083657 | A1 | 4/2011 | Ploof et al. |
| 2011/0126818 | A1 | 6/2011 | Behle et al. |
| 2012/0017770 | A1 | 1/2012 | Sakane et al. |
| 2012/0021100 | A1 | 1/2012 | Thorneywork et al. |
| 2012/0067226 | A1 | 3/2012 | Claesson et al. |
| 2012/0118875 | A1 | 5/2012 | Jussel |
| 2012/0138597 | A1 | 6/2012 | Quella et al. |
| 2012/0187115 | A1 | 7/2012 | Toyoda et al. |
| 2012/0192725 | A1 | 8/2012 | Toyoda et al. |
| 2012/0248095 | A1 | 10/2012 | Lee et al. |
| 2012/0328752 | A1 | 12/2012 | Green |
| 2013/0004630 | A1 | 1/2013 | McFadden |
| 2013/0175253 | A1 | 7/2013 | Shei et al. |
| 2013/0220296 | A1 | 8/2013 | Catalogne et al. |
| 2013/0255657 | A1 | 10/2013 | Schootstra et al. |
| 2013/0306052 | A1 | 11/2013 | Price et al. |
| 2013/0306616 | A1 | 11/2013 | Wildebush |
| 2014/0026764 | A1 | 1/2014 | Sykes et al. |
| 2014/0048055 | A1 | 2/2014 | Ruther |
| 2014/0083309 | A1 | 3/2014 | Reese et al. |
| 2014/0099420 | A1 | 4/2014 | Petronio et al. |
| 2014/0116258 | A1 | 5/2014 | Bigott et al. |
| 2014/0137852 | A1 | 5/2014 | Radford et al. |
| 2014/0161952 | A1 | 6/2014 | Sykes |
| 2014/0161953 | A1 | 6/2014 | Jones et al. |
| 2014/0174426 | A1 | 6/2014 | Moon et al. |
| 2014/0202444 | A1 | 7/2014 | Dobie |
| 2014/0216267 | A1 | 8/2014 | McKee |
| 2014/0217083 | A1 | 8/2014 | McKee |
| 2014/0231407 | A1 | 8/2014 | Kantas |
| 2014/0261373 | A1 | 9/2014 | Yingst et al. |
| 2014/0290003 | A1 | 10/2014 | Mick et al. |
| 2014/0318387 | A1 | 10/2014 | Kim |
| 2014/0322417 | A1 | 10/2014 | Kim |
| 2014/0326710 | A1 | 11/2014 | McKee et al. |
| 2015/0047514 | A1 | 2/2015 | Abe et al. |
| 2016/0050939 | A1 | 2/2016 | Riggle et al. |
| 2016/0066585 | A1 | 3/2016 | Lago |
| 2016/0273843 | A1 | 9/2016 | Wenzel |
| 2016/0327278 | A1 | 11/2016 | McKee et al. |
| 2016/0345592 | A1 | 12/2016 | McKee et al. |
| 2016/0348920 | A1 | 12/2016 | Yingst et al. |
| 2016/0356504 | A1 | 12/2016 | McKee et al. |
| 2016/0356505 | A1 | 12/2016 | McKee et al. |
| 2016/0356506 | A1 | 12/2016 | McKee et al. |
| 2017/0010003 | A1 | 1/2017 | Dougherty |

FOREIGN PATENT DOCUMENTS

| | | | |
|---|---|---|---|
| EP | 1624255 | A1 | 2/2006 |
| EP | 1672284 | A1 | 6/2006 |
| EP | 1732369 | A2 | 12/2006 |
| EP | 2735806 | A1 | 5/2014 |
| WO | 00064219 | A1 | 10/2000 |
| WO | 2005023006 | A2 | 3/2005 |
| WO | 2012/062679 | A1 | 5/2012 |
| WO | 2015101399 | A1 | 7/2015 |
| WO | 2015/175366 | A1 | 11/2015 |

OTHER PUBLICATIONS

Multi-zone Temperature & Time Controller (TC10263). See http://www.degreed.com/en/application-overview/food-equipment/multizone-thermal-controller-tc10263.html (last visited Jun. 8, 2015).

International Search Report for PCT/US2016/030718 dated Jul. 27, 2016.

(56) References Cited

OTHER PUBLICATIONS

Written Opinion of International Searching Authority for PCT/US2016/030718 dated Jul. 27, 2016.
International Search Report for PCT/US2016/030736 dated Aug. 4, 2016.
Nritten Opinion of International Searching Authority for PCT/US2016/030736 dated Aug. 4, 2016.
International Search Report for PCT/US2016/030778 dated Aug. 4, 2016.
Written Opinion of International Searching Authority for PCT/US2016/030778 dated Aug. 4, 2016.

* cited by examiner

COOKING OVEN

CROSS REFERENCE TO RELATED APPLICATION

This application is a continuation-in-part of U.S. application Ser. No. 14/733,533, filed on Jun. 8, 2015, the entire content of which is incorporated herein by reference.

FIELD OF THE INVENTION

The present invention relates to cooking ovens in general, and in particular to a convection oven having removable air plenums.

BACKGROUND OF THE INVENTION

An oven generally includes an oven cavity configured to receive food articles for cooking. The oven also includes a heating element, which can be an electric resistance element or a gas burner, for generating heat energy to cook any food items placed within an oven cavity. Some ovens may include a fan for forcing movement of heated air within the oven cavity, and those ovens are commonly referred to as convection ovens.

Convection ovens have been the workhorse in commercial kitchens for many decades. Commercial convection ovens generally come in two sizes, namely, full-size and half-size. Full-sized commercial convection ovens are designed to fit within the space of an industry standard footprint, which is approximately 40 inches wide by 40 inches deep, made available for full-sized convection ovens in most commercial kitchens. The oven cavity of full-sized commercial ovens are also dimensioned to accept industry standard full-sized cooking trays, which are approximately 26 inches wide by 18 inches deep. The height of the cook cavity is typically about 20 inches, which is capable of being configured to allow for multiple rack heights, such as 11 possible rack heights, to accommodate the height of various foods that can be cooked in a convection oven. For example, only 2 racks may be placed in a commercial convection oven if 9-inch tall turkeys are being cooked, but 4 to 5 racks may be evenly spaced from top to bottom when that many racks of 2-inch tall lasagna are being cooked. Half-sized commercial convection ovens are similarly configured and dimensioned to fit into industry standard half-sized spaces in commercial kitchens and to receive industry standard half-sized sheet pans.

When cooking in a typical convection oven, heated air within the oven cavity is circulated by a fan. The fan initiates a flow of heated air by pulling air from the oven cavity through multiple openings on a back wall of the oven cavity. The heated air then exits other openings on the side walls of the oven cavity. The heated air moves through the oven cavity to help distribute heat energy to food articles placed within the oven cavity. An example of the heating system of a typical convection oven can be found in U.S. Pat. No. 4,395,233 to Smith et al.

One problem with the heating system of a conventional convection oven is that it can generate regions of high and low speed air flow in the oven cavity such that the heated air is not uniformly distributed within the oven cavity. As a result, food items placed in the oven cavity may be cooked unevenly. For example, food items placed on different racks at different heights within the convection oven may be cooked at different rates. In addition, food items placed on the same rack may not receive uniform heating either. This unevenness of cooking can result in food waste, as food items located in the higher heat portions of the oven cavity can be unacceptably overdone as compared to the food items located in the lower heat portions. Unevenness of cooking can be partially overcome by rotating cook trays within the oven cavity, as well as utilizing reduced cooking temperatures and blower speeds, but doing so will increase skilled labor requirements as well as cook times.

Conventional convection ovens have other problems as well. For example, only one cook temperature and heat transfer profile, such as blower speed, can be delivered in a conventional convection oven at any one time, thereby limiting the types of foods that can be cooked simultaneously. This can be overcome by having multiple convection ovens set at different cook temperatures and heat transfer profiles, but doing so will result in space and energy inefficiency.

Consequently, it would be desirable to provide an improved convection oven that can eliminate the above-mentioned problems.

SUMMARY OF THE INVENTION

It has now been found that the above and related objects of the present invention are obtained in the form of several related aspects, including a convection oven having removable air plenums.

In accordance with an exemplary embodiment of the present invention, a convection oven has one or more removable air plenums that can be placed within the oven cavity to divide the cavity into separate cooking chambers. Removable air plenums are connectable to and engageable with air channels of the oven. Each removable air plenum includes an air intake edge for receiving heated air from the engaged air channel in the oven and a plurality of air vents for directing the heated air into the corresponding cooking chamber for the purpose of heating any food items located within the cooking chamber. When a removable air plenum is disengaged from the oven air channel and removed from the oven cavity, the air channel may be covered by a movable flap.

By placing, removing, or re-arranging removable air plenums within the oven cavity, one can arrange to have different number of cooking chambers with variable heights in the convection oven to meet multiple cooking needs simultaneously. The oven may be provided with a control panel that can control each cooking chamber independently.

The oven may have one or two oven doors for accessing all of the cooking chambers. In other words, the size of the oven door(s) is not necessarily dependent on the height of cooking chambers defined by the removable air plenums.

The oven may also have a sensor for detecting the opening of oven doors during a cook cycle. To compensate for any disruption to the cook cycle due to the opened oven door, the oven's controller may extend the cooking time(s) or re-adjust cooking parameters for the cooking chamber(s) based on the measured amount of time the oven doors were kept open during their respective cook cycles.

The present invention also relates to a convection oven comprising a housing having an oven cavity and an oven door for access to the oven cavity, at least one air blower for generating heated air, one or more air channels for directing the heated air from the air blower toward the oven cavity, and one or more removable air plenums, wherein each of the one or more removable air plenums is connected to one of the one or more air channels; comprises an air intake edge for receiving the heated air from the one of the one or more air channels; defines the top or the bottom of a cooking chamber within the oven cavity; and comprises a plurality of air vents for directing the heated air into the cooking chamber.

In at least one embodiment, at least one of the one or more air channels is coverable by a flap if not connected to one of the one or more removable air plenums.

In at least one embodiment, at least one of the one or more removable air plenums comprises a tab configured to open the flap when connected to one of the one or more air channels.

In at least one embodiment, the convection oven further comprises a control panel for separately and independently controlling each of the cooking chambers defined by the one or more removable air plenums.

In at least one embodiment, the convection oven further comprises a sensor for detecting the oven door being kept open during a cook cycle.

In at least one embodiment, the convection oven further comprises a controller for re-adjusting a cooking parameter for at least one of the cooking chambers defined by the one or more removable air plenums based on the amount of time the oven door is kept open during the cook cycle.

In at least one embodiment, at least one of the one or more removable air plenums is configured to direct the heated air upward.

In at least one embodiment, at least one of the one or more removable air plenums is configured to direct the heated air downward.

In at least one embodiment, at least one of the one or more removable air plenums is configured to support a food rack within the corresponding cooking chamber.

The present invention also relates to a cooking oven comprising a housing having an oven cavity and an oven door for access to the oven cavity, an upper air channel, a lower air channel, a removable plenum pair defining the bottom of an upper cooking chamber and the top of a lower cooking chamber in the oven cavity, the plenum pair comprising an upper air plenum removably connected to the upper air channel, the upper air plenum comprising an air intake edge configured to receive air flow from the upper air channel and a plurality of air vents configured to direct the air flow upwards into the upper cooking chamber, and a lower air plenum removably connected to the lower air channel, the lower air plenum comprising an air intake edge configured to receive air flow from the lower air channel and a plurality of air vents configured to direct the air flow downwards into the lower cooking chamber, and an air blower configured to send heated air to the upper air channel and the lower air channel.

In at least one embodiment, the air blower comprises an upper air blower configured to send heated air toward the upper cooking chamber, and a lower air blower configured to send heated air toward the lower cooking chamber.

In at least one embodiment, the cooking oven further comprises an upper air diverter positioned in front of an outlet of the upper air blower and configured to direct a portion of the heated air from the upper air blower into the upper air plenum through the upper air channel, and a lower air diverter positioned in front of an outlet of the lower air blower and configured to direct a portion of the heated air from the lower air blower into the lower air plenum through the lower air channel.

In at least one embodiment, at least one of the upper air diverter and the lower air diverter comprises two substantially identical planar elements joined along a side nearest to the outlet of the corresponding one of the upper air blower and the lower air blower at an angle to form a substantially symmetrical “>” shape when viewed from the side.

In at least one embodiment, the tip of the “>” shaped air diverter points to the vertical center of the outlet of the corresponding one of the upper air blower and the lower air blower.

In at least one embodiment, the distance between the nearest side of the “>” shaped air diverter and the outlet of the corresponding one of the upper air blower and the lower air blower is substantially 2.4 inches.

In at least one embodiment, the angle between the two planar elements is fixed.

In at least one embodiment, the angle between the two planar elements is between 45 degrees and 90 degrees.

In at least one embodiment, the angle between the two planar elements is between 55 degrees and 80 degrees.

In at least one embodiment, the angle between the two planar elements is between 65 degrees and 70 degrees.

In at least one embodiment, the angle between the two planar elements is about 68 degrees.

In at least one embodiment, the angle between the two planar elements is adjustable.

In at least one embodiment, each of the two planar elements is substantially in the shape of an isosceles trapezoid.

In at least one embodiment, the distance between the upper air diverter and the outlet of the upper air blower is adjustable.

In at least one embodiment, the distance between the lower air diverter and the outlet of the lower air blower is adjustable.

In at least one embodiment, at least one of the upper air plenum and the lower air plenum comprises a first surface and a second surface opposite to the first surface, the first surface comprising a flat planar surface having the plurality of air vents and the second surface being slanted toward the first surface so that the vertical spacing between the first surface and the second surface at the air intake edge of the air plenum is greater than the vertical spacing between the first surface and the second surface at a distal end of the air plenum.

In at least one embodiment, the vertical spacing between the first surface and the second surface at the air intake edge of the air plenum is substantially one inch.

In at least one embodiment, the second surface is slanted at a greater angle at the air intake edge than at near the distal end.

In at least one embodiment, the second surface comprises at least two planar elements which are slanted toward the first surface at different angles.

In at least one embodiment, the second surface is slanted at 4.5 degrees at the air intake edge and at 1.0 degree at near the distal end.

In at least one embodiment, the upper air channel and the lower air channel are located on a back wall of the oven cavity.

In at least one embodiment, each of the upper air channel and the lower air channel is coverable by a flap if not connected to the corresponding one of the upper air plenum and the lower air plenum.

In at least one embodiment, each of the upper air plenum and the lower air plenum comprises a tab configured to open the flap when connected to the corresponding one of the upper air channel and the lower air channel.

In at least one embodiment, the removable plenum pair further comprises a tab to ensure that each of the upper air plenum and the lower air plenum is sealed to the corresponding air channel. The tab is configured and positioned in the removable plenum pair in such a way that when the oven doors close, the metal edge of the door frame strikes the tab if each of the upper air plenum and the lower air plenum in the plenum pair is not pushed all the way against the corresponding air channel on the back wall.

In at least one embodiment, the cooking oven further comprises a control panel for separately and independently controlling the upper cooking chamber and the lower cooking chamber.

In at least one embodiment, the cooking oven further comprises a sensor for detecting the oven door being kept open during a cook cycle.

In at least one embodiment, the cooking oven further comprises a controller for re-adjusting a cooking parameter for at least one of the upper cooking chamber and the lower cooking chamber based on the amount of time the oven door is kept open during the cook cycle.

In at least one embodiment, the upper air plenum is configured to support a food rack for the upper cooking chamber.

In at least one embodiment, the cooking oven further comprises return air openings on left and right side walls of the oven cavity.

In at least one embodiment, the cooking oven further comprises an upper moveable flap for covering the upper air channel, a lower moveable flap for covering the lower air channel, a rod, and a flange attached to the rod at a front end and coupled to the upper moveable flap and the lower moveable flap at a back end via one or more pivots, wherein the rod and the flange form a moveable assembly which is capable of pulling the upper moveable flap and the lower moveable flap over the upper air channel and the lower air channel and pushing the upper moveable flap and the lower moveable flap away from the upper air channel and the lower air channel by moving back and forth, respectively.

These and other features and advantages of the present invention will become apparent in the following detailed written description of various exemplary embodiments of this invention.

BRIEF DESCRIPTION OF THE DRAWINGS

The invention itself, as well as a preferred mode of use, further objects, and advantages thereof, will best be understood by reference to the following detailed description of illustrative and exemplary embodiments when read in conjunction with the accompanying drawings, wherein.

DETAILED DESCRIPTION OF THE EXEMPLARY EMBODIMENTS

Figure 1:
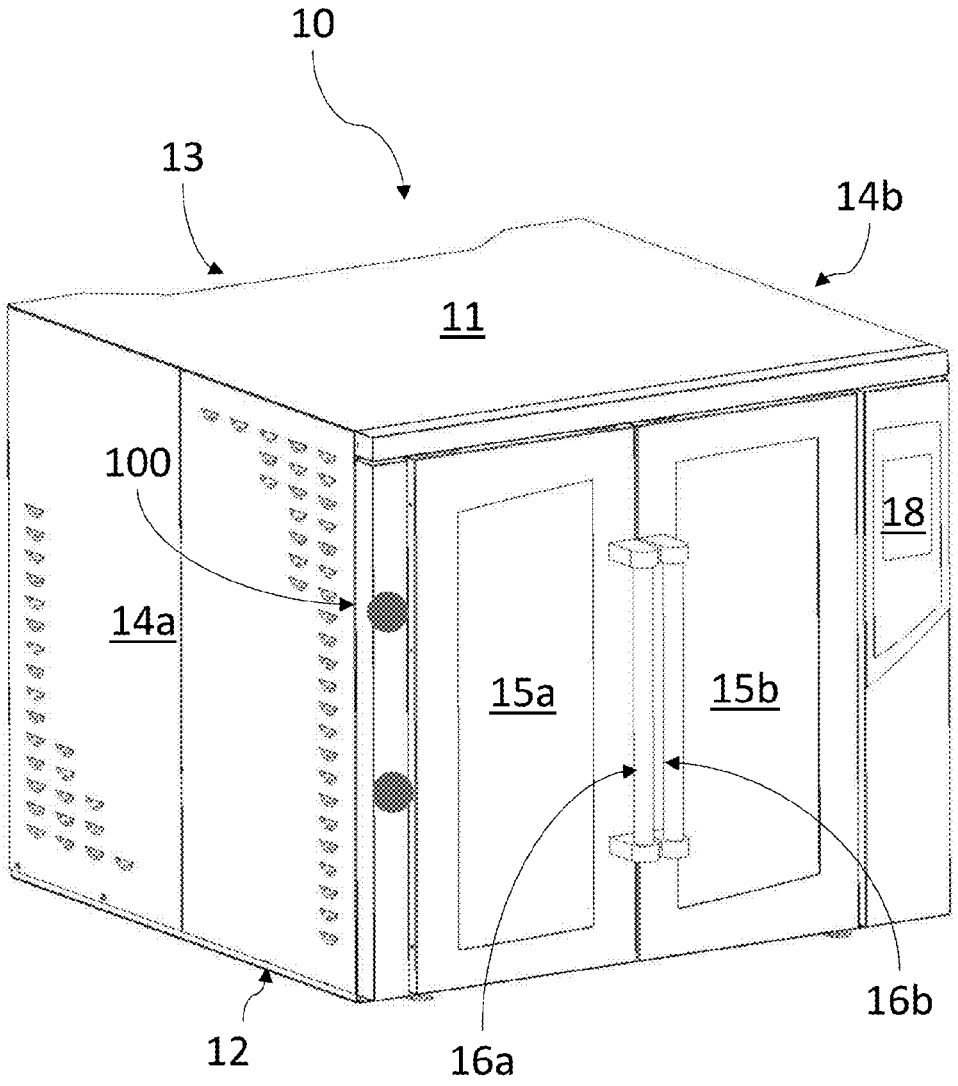
FIG. 1 is an isometric view of a convection oven, in accordance with an exemplary embodiment of the present invention.

Referring now to the drawings and in particular to FIG. 1, there is depicted an isometric view of a convection oven, in accordance with an exemplary embodiment of the present invention. As shown, a convection oven 10 includes a housing having a top panel 11, a bottom panel 12, a rear panel 13 and two side panels 14*a*, 14*b*.

A pair of oven doors 15*a*, 15*b* may form the front panel of the housing and are pivotally connected with side panels 14*a*, 14*b*, respectively, via hinges. Oven doors 15*a* and 15*b* may include handles 16*a* and 16*b*, respectively, for opening and closing the same, and a latch may be provided to keep doors 15*a*, 15*b* in a closed position. Door sensing switches (not shown) may be used to sense when oven doors 15*a*, 15*b* are being opened or closed.

In alternative embodiments, instead of a pair of oven doors, the oven may include a single oven door (not shown) which is pivotally connected with one of side panels 14*a*, 14*b*, top panel 11, or bottom panel 12 via hinges, or one or more bottom hinged doors (also not shown).

Convection oven 10 also includes a control panel 18, which may be implemented with touchscreen technology. An operator can enter commands or cooking parameters, such as cooking temperature, cooking time, fan speed, etc., via control panel 18 to effectuate cooking controls on any food items placed within convection oven 10.

Figure 2A:
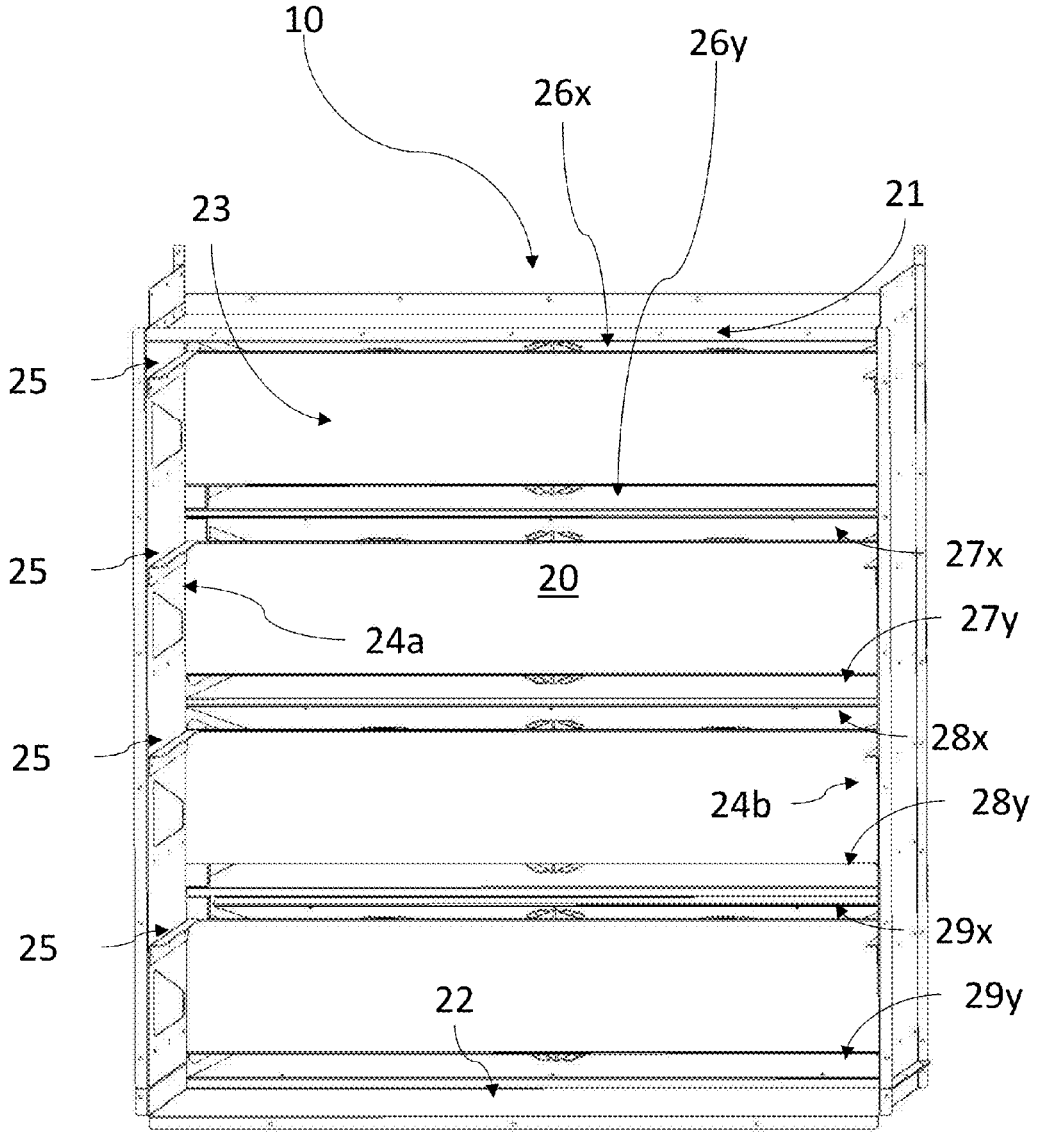
FIG. 2A is a front view of an oven cavity within the convection oven from FIG. 1, in accordance with an exemplary embodiment of the present invention.
Figure 2B:
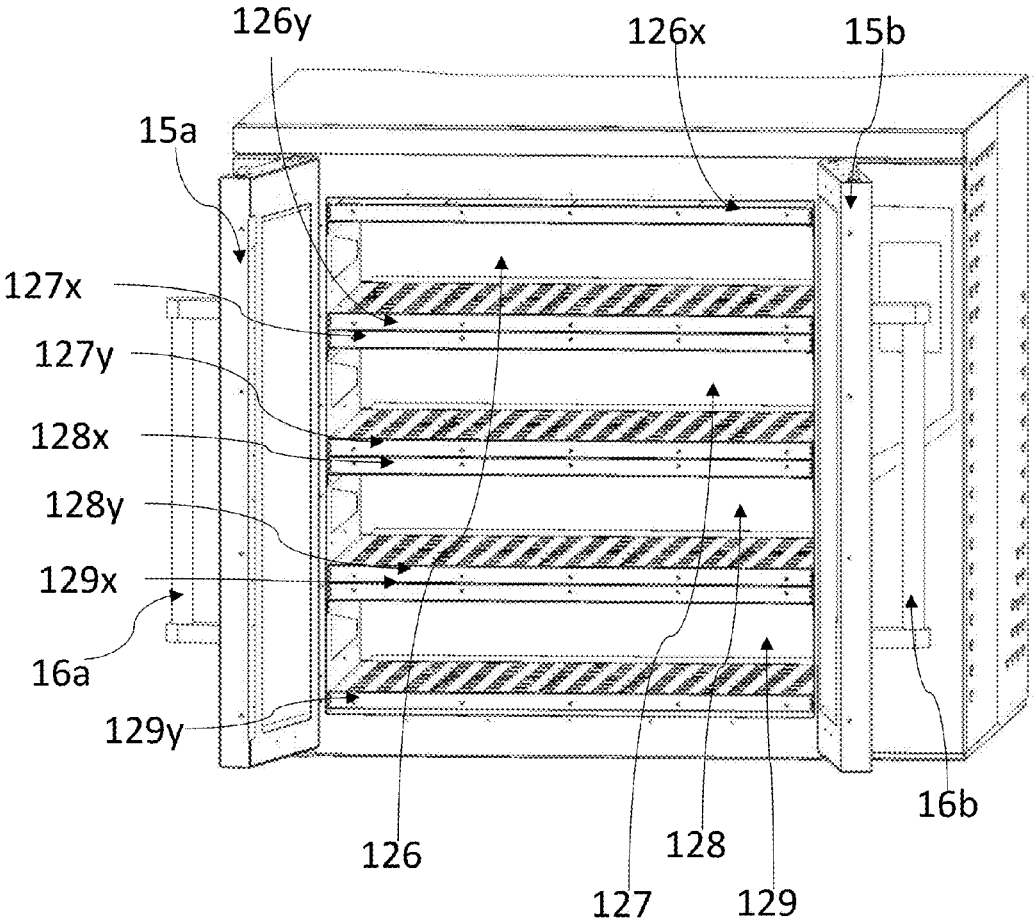
FIG. 2B is an isometric view of the oven cavity from FIG. 2A with multiple cooking chambers formed and defined by removable air plenums placed within the oven cavity.

With reference now to FIGS. 2A-2B, there are depicted front and isometric views, respectively, of an oven cavity 20 within convection oven 10, in accordance with an exemplary embodiment of the present invention. As shown, oven cavity 20 is defined by a top wall 21, a bottom wall 22, a back wall 23, and side walls 24*a*, 24*b* along with oven doors 15*a*, 15*b*. The size of oven cavity 20 may be about 9.5 cubic feet in a full sized version in accordance with the exemplary embodiment. Located on side walls 24*a*, 24*b* are multiple parallel rails 25 (e.g., four rails shown in FIG. 2A) configured to support one or more removable air plenums, which may also serve as food rack supports, to direct heated air flow.

Located on back wall 23 are multiple sets of air channel pairs (e.g., four sets shown in FIG. 2A) for bringing hot air into oven cavity 20. In the exemplary embodiment shown in FIG. 2A, a first set of air channel pairs includes a top air channel 26*x* and a bottom air channel 26*y*, a second set of air channel pairs includes a top air channel 27*x* and a bottom air channel 27*y*, a third set of air channel pairs includes a top air channel 28*x* and a bottom air channel 28*y*, and a fourth set of air channel pairs includes a top air channel 29*x* and a bottom air channel 29*y*. Each of the four air channel pairs can be configured to separately and independently send heated air into oven cavity 20.

In FIG. 2B, oven cavity 20 is shown to be populated with multiple removable air plenums 126*x*-129*x* and 126*y*-129*y*. These removable air plenums divide the oven cavity 20 into and define multiple (e.g., four in this case) cooking chambers 126, 127, 128, 129. As shown in FIG. 2B, removable air plenum 126*x* and removable air plenum 126*y* define a cooking chamber 126; removable air plenum 127*x* and removable air plenum 127*y* define a cooking chamber 127; removable air plenum 128*x* and removable air plenum 128*y* define a cooking chamber 128; and removable air plenum 129*x* and removable air plenum 129*y* define a cooking chamber 129. The size of at least one of these cooking chambers 126, 127, 128, 129 may range between 1.4 and 1.9 cubic feet in accordance with the exemplary embodiment.

As also shown in FIG. 2B, a pair of adjacent removable air plenums ("a removable plenum pair") may together define the bottom of an upper cooking chamber and the top of a lower cooking chamber: Air plenums 126*y* and 127*x* together define the bottom of cooking chamber 126 and the top of cooking chamber 127; air plenums 127*y* and 128*x* together define the bottom of cooking chamber 127 and the top of cooking chamber 128; and air plenums 128*y* and 129*x* together define the bottom of cooking chamber 128 and the top of cooking chamber 129.

The number and the size of cooking chambers within oven cavity 20 may be changed or adjusted by removing one or more removable plenum pairs from oven cavity 20. For example, by removing plenum pair 128*y* and 129*x* shown in FIG. 2B, oven cavity 20 has a relatively large cooking chamber on the bottom (with the combined space for cooking chambers 128 and 129) and two smaller cooking chambers 126, 127.

In accordance with an exemplary embodiment of the present invention, the multiple removable air plenums 126*x*-129*x* and 126*y*-129*y* may be all substantially identical to each other in structure. In alternative embodiments, each or some of them may be configured differently.

In the exemplary embodiment shown in FIGS. 2A and 2B, air plenum 126*x* may be removably connected to or inserted into top air channel 26*x*; air plenum 126*y* may be removably connected to or inserted into bottom air channel 26*y*; air plenum 127*x* may be removably connected to or inserted into top air channel 27*x*; air plenum 127*y* may be removably connected to or inserted into bottom air channel 27*y*; air plenum 128*x* may be removably connected to or inserted into top air channel 28*x*; air plenum 128*y* may be removably connected to or inserted into bottom air channel 28*y*; air plenum 129*x* may be removably connected to or inserted into top air channel 29*x*; and air plenum 129*y* may be removably connected to or inserted into bottom air channel 29*y*.

Together, removable air plenums defining a cooking chamber within oven cavity 20 (e.g., removable air plenums 127*x* and 127*y* for cooking chamber 127) function to direct heated air from the corresponding air channels (e.g., top and bottom air channels 27*x* and 27*y*) into the cooking chamber (e.g., cooking chamber 127), from the top and the bottom of the cooking chamber, for the purpose of heating any food items located within the cooking chamber.

Figure 3A:
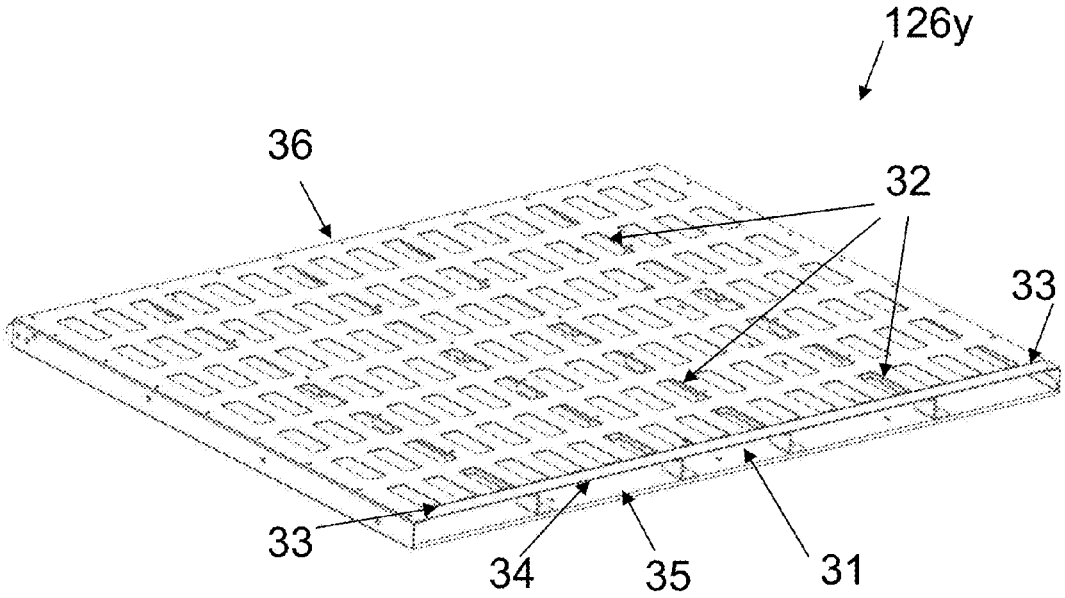
FIG. 3A is an isometric view of a removable air plenum from FIG. 2B.

Referring now to FIG. 3A, there is depicted an isometric view of an exemplary embodiment of a removable air plenum, such as removable air plenum 126*y*. As shown, removable air plenum 126*y* has an air intake edge 31 on one end and a distal end 36 at the opposite end. Air intake edge 31 is configured to be removably connected to an air channel, such as air channel 26*y*, to receive heated air. Distal end 36 is closed off and covered to permit no air flow through the distal end.

The interior space of removable air plenum 126*y* into which heated air is received from an air channel may be defined by a first surface 34 and a second surface 35 opposite to first surface 34. First surface 34 comprises a flat planar surface having a plurality of air vents 32. Air vents 32 are configured to direct the heated air received through air intake edge 31 into a cooking chamber in oven cavity 20, such as cooking chamber 126. As an example, the size of each air vent 32 may range between 1.25 and 2.5 square inches. While each of air vents 32 shown in FIG. 3A has the shape of a rectangle, it may have a different shape in alternative embodiments, such as square, circle, ellipse, rhombus, trapezoid, hexagon, or other type of regular or irregular geometric shape, Second surface 35 preferably permits no air flow through it.

Figure 3B:
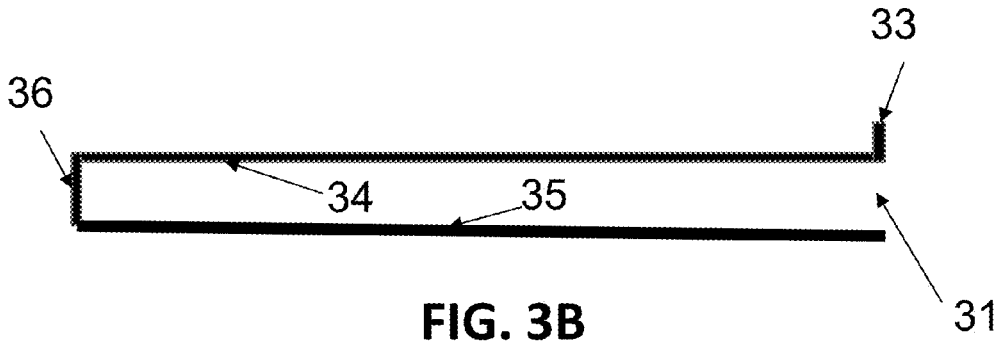
FIGS. 3B-3D are cross-sectional side views of various alternative embodiments of a removable air plenum.
Figure 3C:
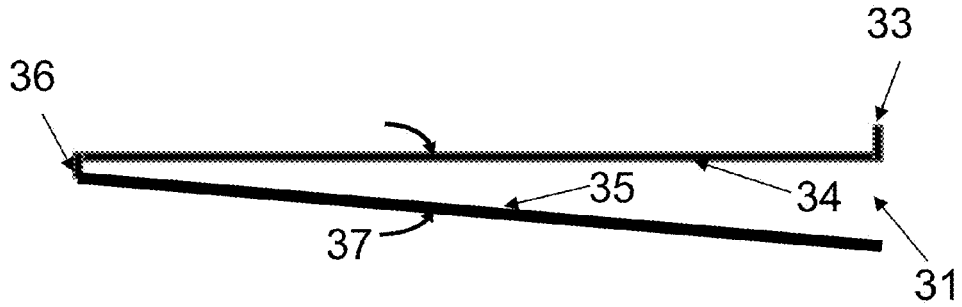
Figure 3D:
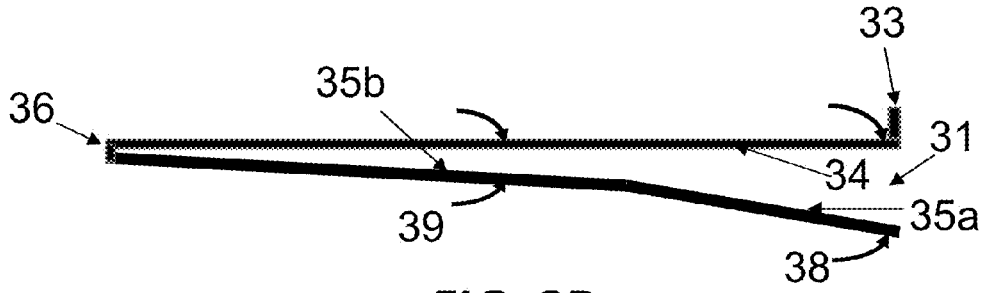

Referring now to FIGS. 3B through 3D, there are depicted cross-sectional side views of various exemplary embodiments of a removable air plenum, such as removable air plenum 126*y*. In these exemplary embodiments, the vertical spacing between first surface 34 and second surface 35 at air intake edge 31 is preferably substantially 1.0 inch. In alternative embodiments, the vertical spacing between first surface 34 and second surface 35 at air intake edge 31 and/or at any other portion of the removable air plenum may be adjustable depending on the dimension of an air channel, desired amount of heated air moving through the removable air plenum, etc.

In one exemplary embodiment shown in FIG. 3B, first surface 34 and second surface 35 are both flat and parallel to each other. Thus, the vertical spacing between first surface 34 and second surface 35 are constant throughout the removable air plenum.

In an alternative embodiment shown in FIG. 3C, second surface 35 comprises a planar surface which is slanted toward first surface 34 at a constant angle 37 as it approaches distal end 36. In this configuration, the cross section of the interior space of the removable air plenum becomes smaller as the received heated air approaches distal end 36. This configuration enables the heated air coming out through the air vents 32 that are located far from air intake edge 31 to be more focused, thereby facilitating substantially even distribution of heated air flow from the removable air plenum throughout the front and back portions of a cooking chamber in oven cavity 20.

In another alternative embodiment shown in FIG. 3D, second surface 35 may comprise two or more planar surface elements (two planar surface elements are shown in FIG. 3D) each of which is slanted toward first surface 34 at a different angle. Preferably, second surface 35 is slanted toward first surface 34 at a larger angle at air intake edge 31 than at near distal end 36. For example, in FIG. 3D, a first planar surface element 35*a* of second surface 35 located between air intake edge 31 and an intermediate point of the air plenum (e.g., at about a third of the horizontal distance between air intake edge 31 and distal end 36 as shown FIG. 3D) may be slanted toward first surface 34 at an angle 38 of approximately 4.5 degrees. On the other hand, a second planar surface element 35*b* located between the intermediate point and distal end 36 may be slanted toward first surface 34 at a smaller angle 39 of approximately 1.0 degree. The intermediate point where first planar surface element 35*a* ends and second planar surface element 35*b* begins may be selected at about a quarter, a third, or a half of the horizontal distance between air intake edge 31 and distal end 36. Alternatively, the location of the intermediate point may be determined based on optimization of even distribution of heated air flow from the removable air plenum into both the front and back portions of a cooking chamber in oven cavity 20.

In yet another alternative embodiment (not shown), second surface 35 may be curved toward first surface 34 at continuously decreasing angles (from the largest angle at air intake edge 31 to the smallest angle at distal end 36) as it approaches distal end 36.

Referring back to FIG. 3A, removable air plenum 126*y* may also include a tab 33 (or a set of tabs). A tab 33 functions to open a flap (not shown) that covers air channel 26*y* when removable air plenum 126*y* is not connected to or inserted into air channel 26*y*.

In alternative embodiments, removable air plenum 126*y* may also include a different kind of tab(s) (not shown) to ensure that air plenum 126*y* is sealed to the corresponding air channel 26*y*. The tab may be configured and positioned in air plenum 126*y* in such a way that when the oven doors (e.g., oven doors 15*a*, 15*b* shown in FIGS. 1 and 2B) close, the metal edge of the door frame strikes the tab if air plenum 126*y* is not pushed all the way against the corresponding air channel 26*y* on back wall 23. In this way, as the oven doors close, a tab can be used to push air plenum 126*y* all the way against back wall 23 and perfect the seal between air plenum 126*y* and air channel 26*y*.

Figure 4A:
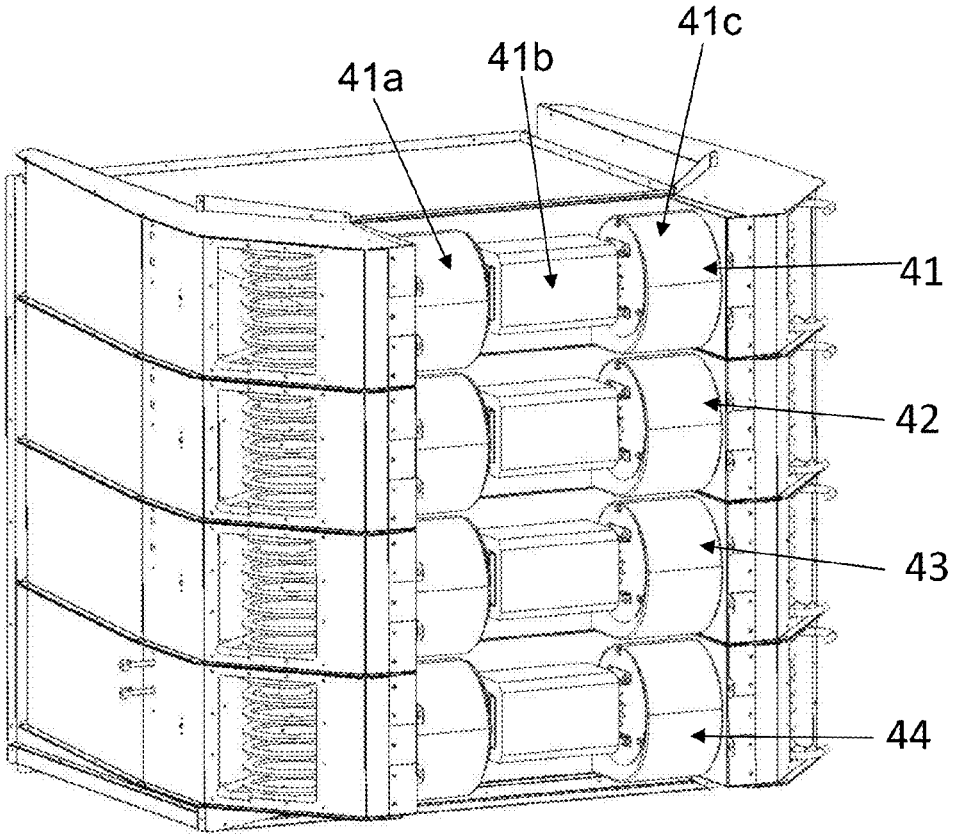
FIG. 4A is an isometric view of a group of air blower systems for the convection oven from FIG. 1 in accordance with an exemplary embodiment of the present invention.
Figure 4B:
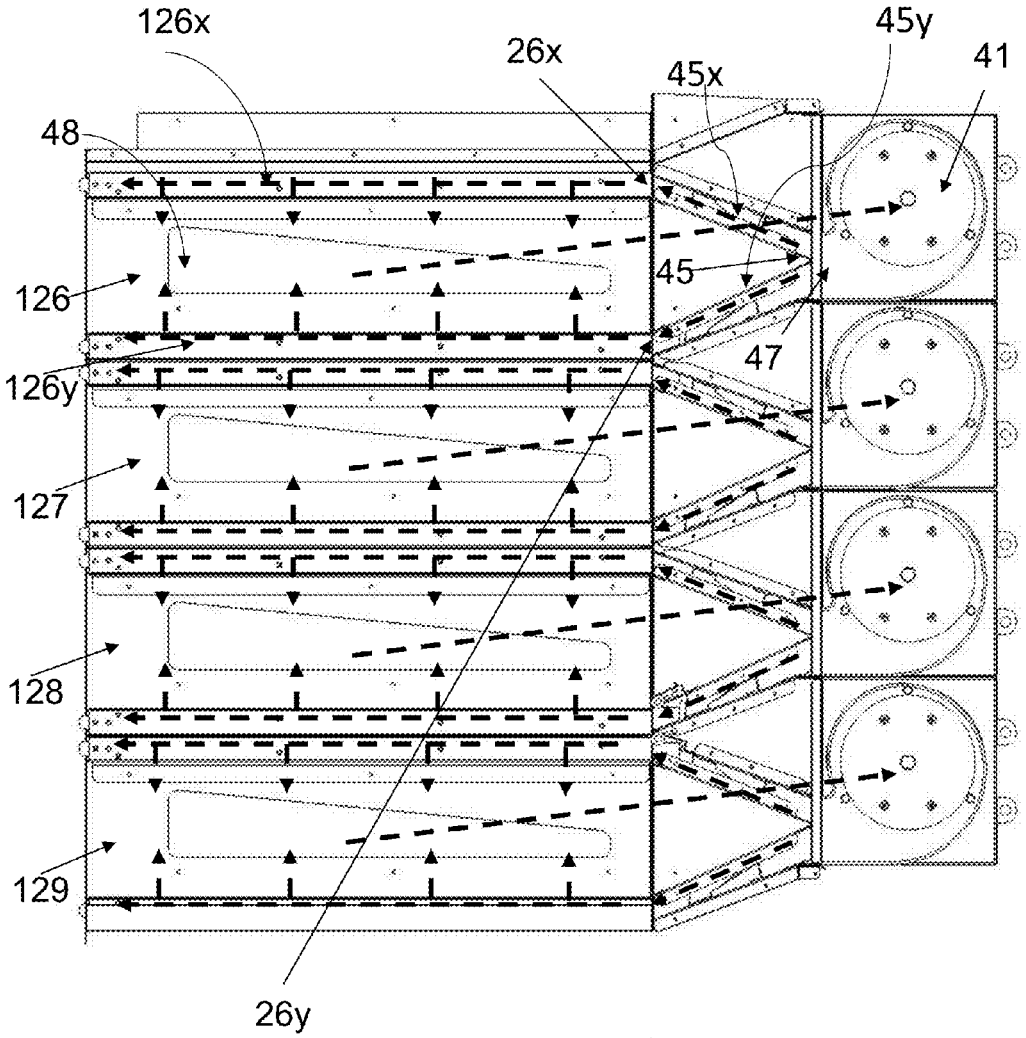
FIG. 4B is a cross-sectional side view of the convection oven from FIG. 1 in accordance with an exemplary embodiment of the present invention.

With reference now to FIGS. 4A-4B, there are depicted isometric and cross-sectional side views, respectively, of a group of air blower systems and the associated airflow path within convection oven 10 in accordance with an exemplary embodiment of the present invention. As shown, four air blower systems 41-44 may be located at the rear of convection oven 10. Each of air blower systems 41-44 may be equipped with its own heater and may further be controlled independently of the other blower systems with respect to both temperature and/or blower speed. In this exemplary embodiment, air blower systems 41-44 all have substantially identical structure and similar airflow path. Hence, only blower system 41 will be further described below in details. In alternative embodiments, each or some of the blower systems may be differently configured.

As shown in FIG. 4A, air blower system 41 is equipped with two separate but identical air blowers 41*a* and 41*c*, which are driven by a single motor 41*b* placed between the two blowers. As shown in FIG. 4B, blower system 41 sends heated air through an air diverter 45 positioned in front of outlet 47 of air blower system 41.

Figure 5A:
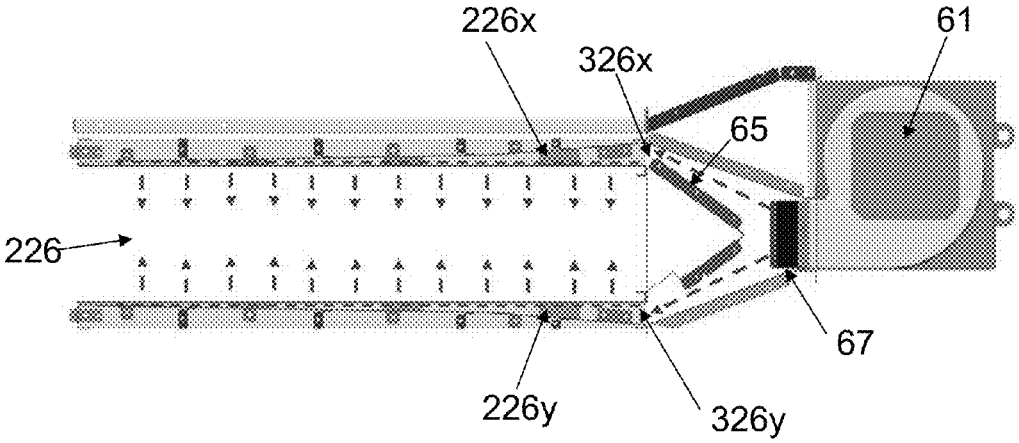
FIGS. 5A-5C are two cross-sectional side views and a cross-sectional top view, respectively, of the convection oven from FIG. 1 in accordance with another exemplary embodiment of the present invention.
Figure 5B:
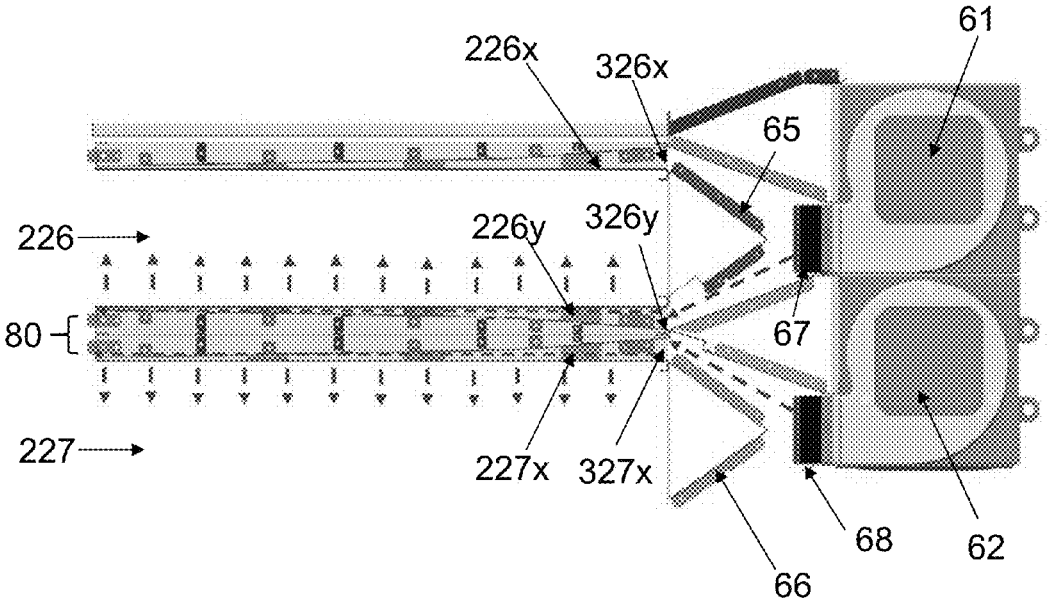
Figure 5C:
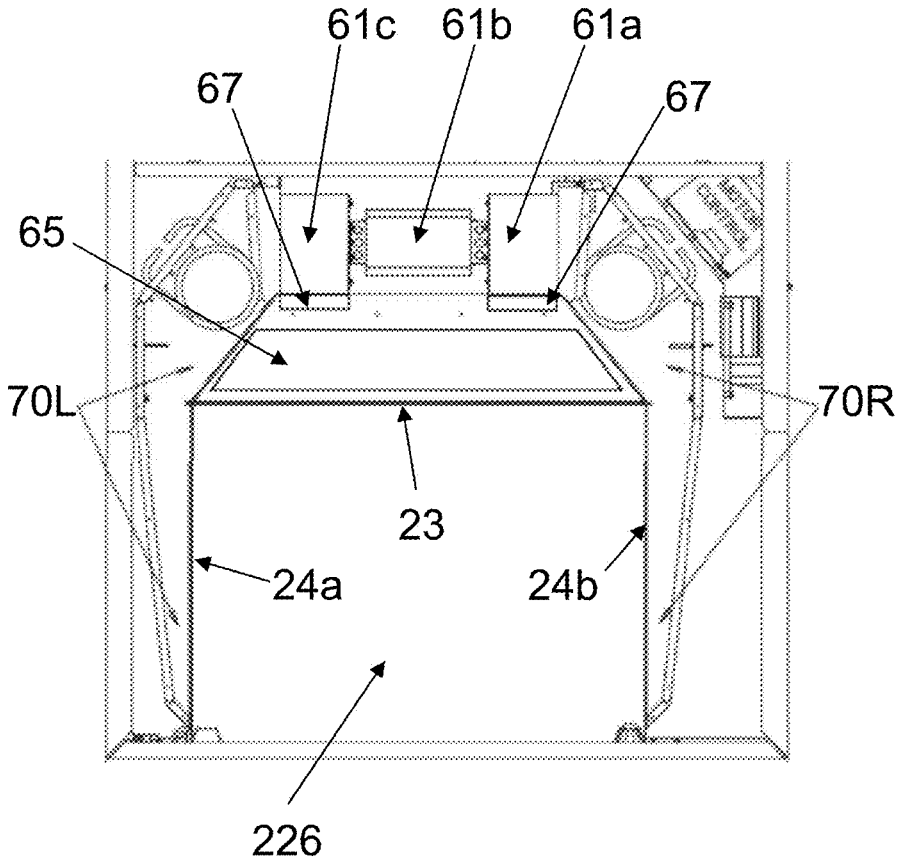

FIG. 4B shows air diverter 45 positioned right next to the outlet 47 of blower system 41. In alternative embodiments, an air diverter may be positioned at a certain distance from the outlet of blower system, as shown in FIGS. 5A-5C and discussed below.

As shown in FIG. 4B, air diverter 45 may comprise two substantially identical planar elements 45*x* and 45*y* joined along the side that is nearest to the outlet of air blowers 41*a*, 41*c* at a fixed angle to form a substantially symmetrical ">" shape when viewed from the side. In accordance with the exemplary embodiment, the angle between the planar elements of the air diverter 65, 66 may be set between 45 degrees and 90 degrees, or between 55 degrees and 80 degrees, or between 65 degrees and 70 degrees. For example, the angle between the planar elements of the air diverter 65, 66 may be about 68 degrees. In alternative embodiments, the angle between the two planar elements forming air diverter 65, 66 may be adjustable.

In FIG. 4B, the tip of the ">" shaped air diverter 45 points toward the vertical center of the outlet 47 of air blower system 41. Air diverter 45 is configured to separate the heated air exiting blower system 41 into a top airstream and a bottom airstream. The ">" shaped diverter is symmetrical to facilitate substantially even allocation of heated air to top and bottom airstreams. Depending on the bias of air blower system 41, slightly more heated air may be allocated to a bottom airstream than to a top airstream. Typically, 53%-60% of heated air from air blower system 41 is allocated to a bottom airstream through air diverter 45, while 40%-47% of heated air is allocated to a top airstream.

The top airstream from air diverter 45 then travels through top air channel 26*x* and enters removable air plenum 126*x* where the heated air is channeled and directed to be substantially evenly disbursed in a downward direction into a cooking chamber in oven cavity 20, such as cooking chamber 126. Similarly, the bottom airstream from air diverter 45 travels through bottom air channel 26*y* and enters removable air plenum 126*y* where the heated air is channeled and directed to be substantially evenly disbursed in an upward direction into cooking chamber 126. Once entering cooking chamber 126, the heated air comes into contact with any food item that is placed on one or more food racks (not shown) within cooking chamber 126. Afterwards, the air within the cooking chamber 126 may be drawn towards return air opening(s) 48 on one or both side walls of oven cavity 20 and travels back to blower system 41.

Referring now to FIGS. 5A-5C, there are depicted two cross-sectional side views and one cross-sectional top view, respectively, of air blower systems 61, 62, air diverters 65, 66, and the associated airflow path within convection oven 10 in accordance with another exemplary embodiment of the present invention.

FIG. 5C is a cross-sectional top view of convection oven 10. As shown in FIG. 5C, air blower system 61 may be equipped with two separate but identical air blowers 61*a* and 61*c*, which are driven by a single motor 61*b* placed between the two blowers. Air blower system 62 shown in FIG. 5B may also have substantially the same structure as air blower system 61.

FIGS. 5A-5B provide cross-sectional side views of two adjacent cooking chamber 226 and cooking chamber 227 within oven cavity 20 which receive heated air from air blower system 61 and air blower system 62, respectively, as indicated by the airflow paths schematically illustrated in the figures. Air blower system 61 sends heated air toward an air diverter 65 positioned in front of the outlet 67 of air blower system 61, and air blower system 62 sends heated air toward an air diverter 66 positioned in front of the outlet 68 of air blower system 62.

Unlike the configuration shown in FIG. 4B, each of air diverters 65, 66 in FIGS. 5A-5C is positioned at a certain distance away from outlet 67, 68 of the corresponding air blower system 61, 62. As an example, the nearest end of air diverter 65, 66 (i.e., the pointed tip of the ">" shaped air diverter) is spaced apart from outlet 67, 68 of air blower system 61, 62 by approximately 2.4 inches. In this example, the distance between outlet 67, 68 of air blower system 61, 62 and cooking chamber 226, 227 in oven cavity 20 is fixed at approximately 6.1 inches. In alternative embodiments, the distance between air diverter 65, 66 and outlet 67, 68 of air blower system 61, 62 may be adjustable.

Air diverters 65 and 66 may be identical in structure. Each of air diverters 65 and 66 may comprise two substantially identical planar elements that are joined along the side nearest to outlet 67, 68 of air blower system 61, 62 at a fixed angle to form a substantially symmetrical ">" shape when viewed from the side. In accordance with the exemplary embodiment, the angle between the planar elements of the air diverter 65, 66 may be set between 45 degrees and 90 degrees, or between 55 degrees and 80 degrees, or between 65 degrees and 70 degrees. For example, the angle between the planar elements of the air diverter 65, 66 may be about 68 degrees. In alternative embodiments, the angle between the two planar elements forming air diverter 65, 66 may be adjustable.

As shown in the top view of FIG. 5C, each of the planar elements forming air diverter 65 may be in the shape of a symmetric isosceles trapezoid, with the narrower side being the nearest to outlet 67 of air blower system 61 and the wider side being the nearest to cooking chamber 226 in oven cavity 20.

Each of air diverters 65, 66 is configured to separate the heated air exiting blower system 61, 62 into a top airstream and a bottom airstream. For example, as shown in FIGS. 5A-5B, the tip of the ">" shaped air diverter 65, 66 points toward the vertical center of the outlet 67, 68 of air blower system 61, 62 to optimize substantially even allocation of heated air exiting outlet 67, 68 to top and bottom airstreams.

As shown in FIG. 5A, the top airstream from air diverter 65 travels through top air channel 326*x* and enters removable air plenum 226*x* where the heated air is channeled and directed to be substantially evenly disbursed in a downward direction into a cooking chamber in oven cavity 20, such as cooking chamber 226. Similarly, the bottom airstream from air diverter 65 travels through bottom air channel 326*y* and enters removable air plenum 226*y* where the heated air is channeled and directed to be substantially evenly disbursed in an upward direction into cooking chamber 226. Once entering cooking chamber 226, the heated air comes into contact with any food item that is placed on one or more food racks (not shown) within cooking chamber 226.

Afterwards, the air within cooking chamber 226 may be drawn towards return air openings 70L and 70R (shown in FIG. 5C), which are respectively located on left and right side walls 24*a*, 24*b* of oven cavity 20 within cooking chamber 226 and travels back to air blower system 61. In at least one embodiment, each of return air openings 70L, 70R is rectangular in shape, approximately 16.5 inches horizontally and approximately 2.5 inches vertically. In at least one embodiment, the front end of each of return air openings 70L, 70R is positioned at approximately 3.1 inches back from the front of oven cavity 20. In at least one embodiment, the bottom end of each of return air openings 70L, 70R is approximately 0.75 inches above a food rack of the corresponding cooking chamber within oven cavity 20.

Referring now to FIG. 5B, there is depicted a cross-sectional side view of a pair of adjacent removable air plenums 226*y* and 227*x*, which form a removable plenum pair 80. Removable plenum pair 80 defines the bottom of an upper cooking chamber in oven cavity 20, such as cooking chamber 226, and the top of a lower cooking chamber in oven cavity 20, such as cooking chamber 227. As shown in FIG. 5B, a portion of heated air exiting from outlet 67 of air blower system 61 travels via air diverter 65 and through bottom air channel 326*y* and enters removable air plenum 226*y* where the heated air is channeled and directed to be substantially evenly disbursed in an upward direction into the upper cooking chamber in oven cavity 20, such as cooking chamber 226. In addition, a portion of heated air exiting from outlet 68 of air blower system 62 travels via air diverter 66 and through top air channel 327*x* and enters removable air plenum 227*x* where the heated air is channeled and directed to be substantially evenly disbursed in a downward direction into the lower cooking chamber in oven cavity 20, such as cooking chamber 227.

In alternative embodiments, removable plenum pair 80 may include one or more tabs (not shown) to ensure that each of removable air plenums 226*y* and 227*x* is sealed to the corresponding air channel 326*y*, 327*x*. The tab may be configured and positioned in removable plenum pair 80 in such a way that when the oven doors (e.g., oven doors 15*a*, 15*b* shown in FIGS. 1 and 2B) close, the metal edge of the door frame strikes the tab if removable plenum pair 80 is not pushed all the way against the corresponding air channels 326*y*, 327*x* on back wall 23. In this way, as the oven doors close, a tab can be used to push removable plenum pair 80 all the way against back wall 23 and perfect the seal between each of air plenums 226*y* and 227*x* and their respective corresponding air channels 326*y*, 327*x*.

Convection oven 10 having a four-cooking chamber configuration (e.g., having four cooking chambers 126, 127, 128, 129), as shown in FIGS. 2B and 4B, can be easily transformed into, for example, a three-cooking chamber configuration, a two-cooking chamber configuration, or a one-cooking chamber configuration by removing one or more removable air plenums (or removable plenum pairs) from oven cavity 20.

Figure 6:
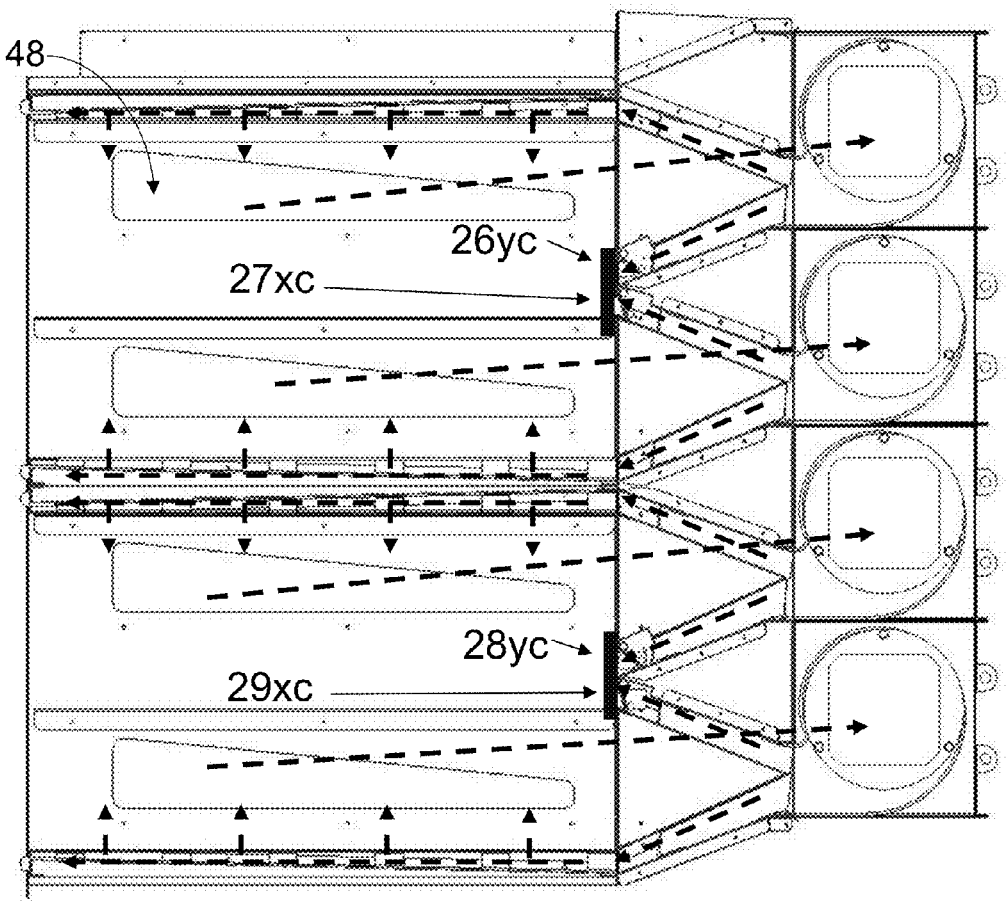
FIG. 6 depicts the air paths within the oven cavity when some of the removable air plenums are removed from the oven cavity of the convection oven from FIG. 1.

Referring now to FIG. 6, there is illustrated the airflow of convection oven 10 in a two-cooking chamber configuration after a plenum pair comprising air plenum 126*y* and air plenum 127*x*, and another plenum pair comprising air plenum 128*y* and air plenum 129*x* have been removed from oven cavity 20. After the removal of air plenums 126*y* and 127*x*, movable flaps 26*yc* and 27*xc* are activated (e.g., drop down) to cover air channels 26*y* and 27*x*, respectively. Similarly, after the removal of air plenums 128*y* and 129*x*, movable flaps 28*yc* and 29*xc* are activated (e.g., drop down) to cover air channels 28*y* and 29*x*, respectively. Flaps 26*yc*, 27*xc*, 28*yc* and 29*xc* enable more heated air to be delivered through the remaining open air channels while also eliminating air entry from the back of oven cavity 20, which would introduce cooking unevenness between food located in the back and food located in the front of oven cavity 20.

In accordance with an exemplary embodiment of the present invention, each of flaps 26*yc*, 27*xc*, 28*yc* and 29*xc* may be automatically engaged and covers the corresponding air channel when a tab 33 of the corresponding removable air plenum (e.g., 126*y* in FIG. 3A) is not in contact or engaged with the corresponding air channel. In other words, when no removable air plenum is connected to and engaged with an air channel (e.g., via tab 33), a flap automatically covers the corresponding air channel. In alternative embodiments, each of flaps 26*yc*, 27*xc*, 28*yc* and 29*xc* may be manually or automatically engaged through any number of methods of covering openings that are well known in the art.

Referring now to FIG. 7A-7D, there are depicted cross-sectional side views of movable flaps 126*yc* and 127*xc* for covering air channels 326*y* and 327*x*, respectively, in accordance with yet another exemplary embodiment of the present invention. While FIGS. 7A-7D do not show removable air plenums, a removable plenum pair 80 comprising upper air plenum 226*y* and lower air plenum 227*x* can be connected to air channels 326*y* and 327*x* and define upper and lower cooking chambers 226 and 227 within oven cavity 20, as illustrated in FIG. 5B.

In this exemplary embodiment, flap opening/closing mechanism may include an exterior knob 100 positioned to the left of oven door 15*a* (as shown in FIG. 1). Knob 100 is connected to a rod 101 that runs between left side wall 24*a* of oven cavity 20 and left exterior side panel 14*a* of oven 10 (see FIG. 1). The distal end of rod 101 is attached to the front portion of a flange 102, which is connected to moveable flaps 126*yc* and 127*xc* via corresponding pivots 106, 108. In at least one embodiment, the linked assembly of knob 100, rod 101, and flange 102 can be moved back and forth manually to move flaps 126*yc* and 127*xc* into open and close positions.

Figure 7A:
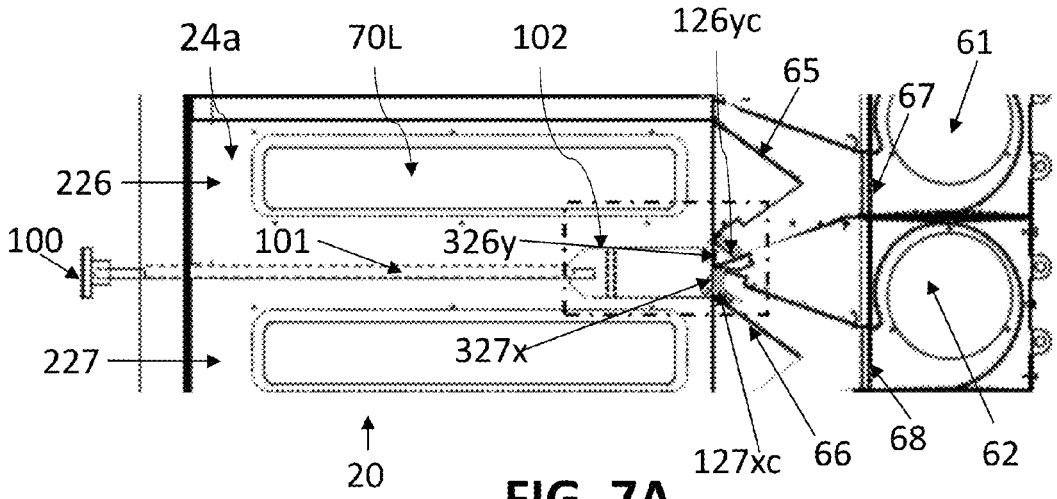
FIGS. 7A-7D are cross-sectional side views of the convection oven from FIG. 1 in accordance with yet another exemplary embodiment of the present invention.
Figure 7B:
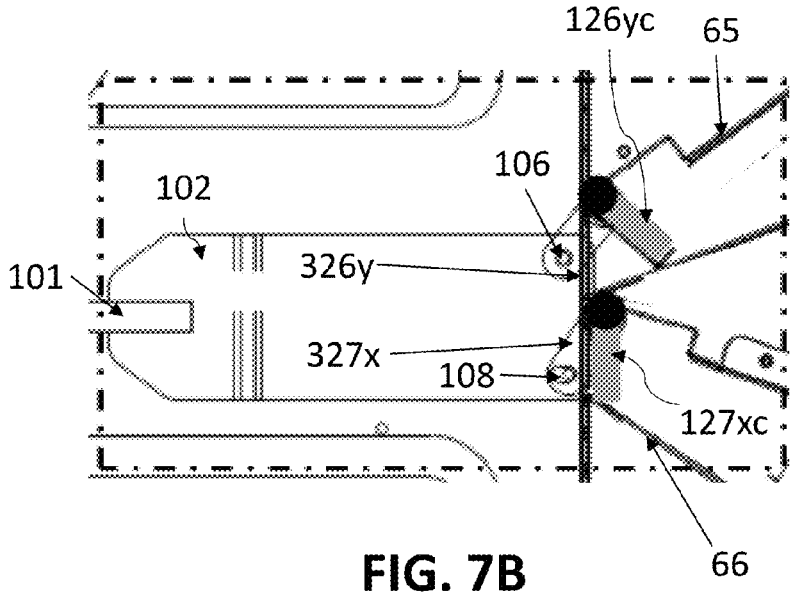

As shown in FIG. 7A, when knob 100 is in the "out" position (e.g., pulled forward in direction away from oven cavity 20), flange 102 pulls flaps 126*yc* and 127*xc* over air channels 326*y* and 327*x* via corresponding pivots 106 and 108, respectively, thereby keeping heated air exiting from outlets 67, 68 of air blower systems 61, 62 from entering removable plenum pair 80 (not shown; see FIG. 5B) through air channels 326*y* and 327*x*. FIG. 7B depicts an enlarged cross-sectional side view of flaps 126*yc* and 127*xc* being pulled over and blocking air channels 326*y* and 327*x*.

Figure 7C:
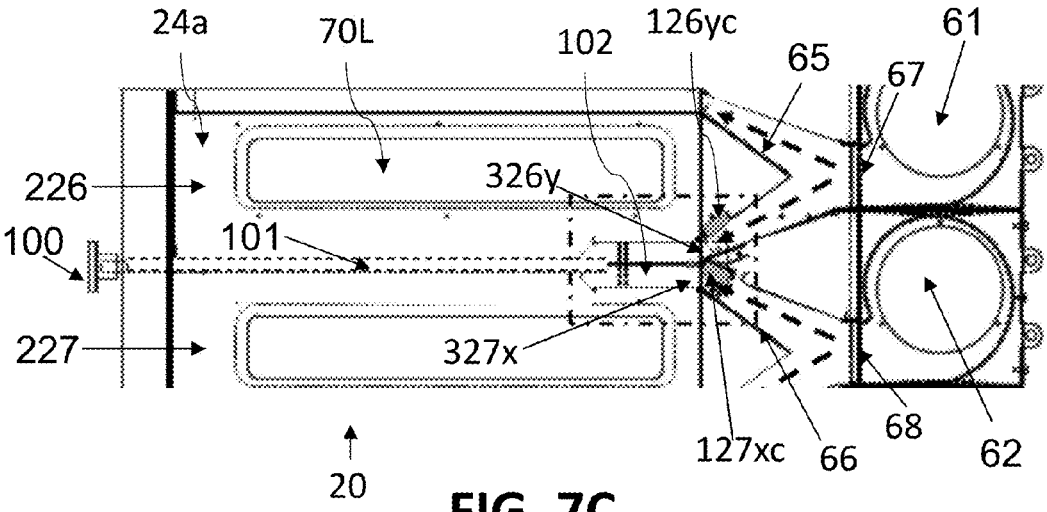
Figure 7D:
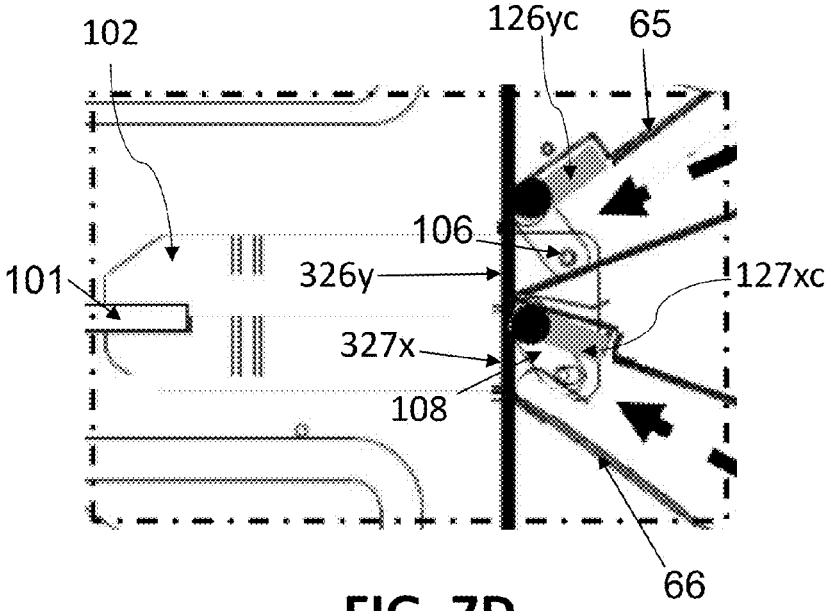

On the other hand, as shown in FIG. 7C, when knob 100 is in the "in" position (e.g., pushed backward in direction toward oven cavity 20), flange 102 slides further inward, pushing flaps 126*yc* and 127*xc* away from air channels 326*y* and 327*x* via corresponding pivots 106 and 108, thereby allowing heated air exiting from outlets 67, 68 of air blower systems 61, 62 and moving past air diverters 65, 66 to enter removable plenum pair 80 (not shown; see FIG. 5B) through air channels 326*y* and 327*x*. FIG. 7D is an enlarged cross-sectional side view of flaps 126*yc* and 127*xc* in the open position, allowing air passage through air channels 326*y* and 327*x*.

In alternative embodiments, electric switches, touch-screen, etc. can be used to trigger opening and closing of flaps through electro-mechanical means.

As described above, oven cavity 20 can be re-configured to have different numbers of cooking chambers with variable heights simply by re-arranging the location and the number of removable air plenums (such as a four-cooking chamber configuration shown in FIGS. 2B and 4B and a two-cooking chamber configuration shown in FIG. 6).

Whether in a two-cooking chamber configuration or a four-cooking chamber configuration, each of the cooking chambers within oven cavity 20 may be utilized to cook different food items (e.g., food items that require different cook times and/or different cooking temperature). Using a four-cooking chamber configuration as an example, each of the four cooking chambers can be independently managed by a corresponding one of blower systems 41-44. Specifically, cook times, temperatures, and blower speeds tailored for food items located in each of the four cooking chambers can be separately entered via a control panel, such as control panel 18 in FIG. 1, such that heated air directed to each of the four cooking chambers will be independently supplied from one of blower systems 41-44.

For example, biscuits may be placed in a first cooking chamber (e.g., cooking chamber 126) at 7:30 a.m. to cook for 15 minutes at 350° F. at a medium blower speed. Bacon strips may be placed in a second cooking chamber (e.g., cooking chamber 127) at 7:35 a.m. to cook for 5 minutes at 425° F. at a high blower speed. Pies may be placed in a third cooking chamber (e.g., cooking chamber 128) at about the same time as the bacon strips, but will be cooked for a longer time (e.g., 45 minutes) at a lower temperature (e.g., 325° F.) at a low blower speed. And cookies may be placed in a fourth cooking chamber (e.g., cooking chamber 129) at 7:40 a.m. to cook for 10 minutes at 400° F. at a medium blower speed. In this example, the bacon strips will be done at 7:40 a.m., the biscuits will be done at 7:45 a.m., cookies will be done at 7:50 a.m., and the pies will be done at 8:20 a.m., all using the same convection oven 10.

In the above example, oven doors (such as oven doors 15*a* and 15*b* from FIG. 1) are likely to be opened and closed multiple times while the various food items are in the process of being cooked for a predetermined time. Each time the oven doors are opened, the cooking process already in progress for the various cooking chambers will likely be disrupted. In order to compensate for this disruption, convection oven 10 may include a sensor for detecting opening of oven doors 15*a* and 15*b* during a cook cycle. The length of time that doors 15*a* and 15*b* are kept open may then be recorded and the cooking parameters for the various food items placed within different cooking chambers (e.g., cooking chambers 126, 127, 128, 129) may be re-adjusted based on the amount of time the oven doors are kept open during their respective cook cycles. For example, the cook times for the various food items placed in the various cooking chambers may be extended for an amount of time that is substantially identical or proportional to the amount of time the oven doors are kept open during their respective cook cycles.

As has been described, the present invention provides an improved convection oven providing a more uniform flow of heated air within the cooking chamber and also providing more flexibility for oven configurability.

While this invention has been described in conjunction with exemplary embodiments outlined above and illustrated in the drawings, it is evident that many alternatives, modifications and variations in form and detail will be apparent to those skilled in the art. Accordingly, the exemplary embodiments of the invention, as set forth above, are intended to be illustrative, not limiting, and the spirit and scope of the present invention is to be construed broadly and limited only by the appended claims, and not by the foregoing specification.

What is claimed is:

1. A cooking oven comprising:

a housing having an oven cavity and an oven door for access to the oven cavity;

an upper air channel;

a lower air channel;

a removable plenum pair defining the bottom of an upper cooking chamber and the top of a lower cooking chamber in the oven cavity, the plenum pair comprising:

an upper air plenum removably connected to the upper air channel, the upper air plenum comprising an air intake edge configured to receive air flow from the upper air channel and a plurality of air vents configured to direct the air flow upwards into the upper cooking chamber; and a lower air plenum removably connected to the lower air channel, the lower air plenum comprising an air intake edge configured to receive air flow from the lower air channel and a plurality of air vents configured to direct the air flow downwards into the lower cooking chamber;

an air blower system configured to send heated air to the upper air channel and the lower air channel, the air blower system comprising:

an upper air blower configured to send heated air toward the upper cooking chamber; and a lower air blower configured to send heated air toward the lower cooking chamber;

an upper air diverter positioned in front of an outlet of the upper air blower and configured to direct a portion of the heated air from the upper air blower into the upper air plenum through the upper air channel; and a lower air diverter positioned in front of an outlet of the lower air blower and configured to direct a portion of the heated air from the lower air blower into the lower air plenum through the lower air channel.

2. The cooking oven of claim 1, wherein at least one of the upper air diverter and the lower air diverter comprises two substantially identical planar elements joined along a side nearest to the outlet of the corresponding one of the upper air blower and the lower air blower at an angle to form a substantially symmetrical ">" shape when viewed from the side.

3. The cooking oven of claim 2, wherein a tip of the ">" shaped air diverter points to the vertical center of the outlet of the corresponding one of the upper air blower and the lower air blower.

4. The cooking oven of claim 2, wherein the distance between the nearest side of the ">" shaped air diverter and the outlet of the corresponding one of the upper air blower and the lower air blower is substantially 2.4 inches.

5. The cooking oven of claim 2, wherein the angle between the two planar elements is fixed.

6. The cooking oven of claim 2, wherein the angle between the two planar elements is between 65 degrees and 70 degrees.

7. The cooking oven of claim 2, wherein the angle between the two planar elements is adjustable.

8. The cooking oven of claim 2, wherein each of the two planar elements is substantially in the shape of an isosceles trapezoid.

9. The cooking oven of claim 1, wherein the distance between the upper air diverter and the outlet of the upper air blower is adjustable.

10. The cooking oven of claim 1, wherein the distance between the lower air diverter and the outlet of the lower air blower is adjustable.

11. The cooking oven of claim 1, wherein at least one of the upper air plenum and the lower air plenum comprises a first surface and a second surface opposite to the first surface, the first surface comprising a flat planar surface having the plurality of air vents and the second surface being slanted toward the first surface so that the vertical spacing between the first surface and the second surface at the air intake edge of the air plenum is greater than the vertical spacing between the first surface and the second surface at a distal end of the air plenum.

12. The cooking oven of claim 11, wherein the vertical spacing between the first surface and the second surface at the air intake edge of the air plenum is substantially one inch.

13. The cooking oven of claim 11, wherein the second surface is slanted at a greater angle at the air intake edge than at near the distal end.

14. The cooking oven of claim 11, wherein the second surface comprises at least two planar elements which are slanted toward the first surface at different angles.

15. The cooking oven of claim 11, wherein the second surface is slanted at 4.5 degrees at the air intake edge and at 1.0 degree at near the distal end.

16. The cooking oven of claim 1, wherein the upper air channel and the lower air channel are located on a back wall of the oven cavity.

17. The cooking oven of claim 1, wherein each of the upper air channel and the lower air channel is coverable by a flap when not connected to the corresponding one of the upper air plenum and the lower air plenum.

18. The cooking oven of claim 17, wherein each of the upper air plenum and the lower air plenum comprises a tab configured to open the flap when connected to the corresponding one of the upper air channel and the lower air channel.

19. The cooking oven of claim 1, further comprising a control panel for separately and independently controlling the upper cooking chamber and the lower cooking chamber.

20. The cooking oven of claim 1, further comprising a sensor for detecting the oven door being kept open during a cook cycle.

21. The cooking oven of claim 20, further comprising a controller for re-adjusting a cooking parameter for at least one of the upper cooking chamber and the lower cooking chamber based on the amount of time the oven door is kept open during the cook cycle.

22. The cooking oven of claim 1, wherein the upper air plenum is configured to support a food rack for the upper cooking chamber.

23. The cooking oven of claim 1, further comprising return air openings on left and right side walls of the oven cavity.

24. The cooking oven of claim 1, further comprising:

an upper moveable flap for covering the upper air channel;

a lower moveable flap for covering the lower air channel;

a rod; and a flange attached to the rod at a front end and coupled to the upper moveable flap and the lower moveable flap at a back end via one or more pivots, wherein the rod and the flange form a moveable assembly which is capable of pulling the upper moveable flap and the lower moveable flap over the upper air channel and the lower air channel and pushing the upper moveable flap and the lower moveable flap away from the upper air channel and the lower air channel by moving back and forth, respectively.

* * * * *